US006575220B2

(12) United States Patent
Tamai et al.

(10) Patent No.: US 6,575,220 B2
(45) Date of Patent: Jun. 10, 2003

(54) MARK TRANSFER TOOL AND MARK TRANSFER TAPE

(75) Inventors: Shigeru Tamai, Ikeda (JP); Masatoshi Shitani, Sanda (JP); Kouhei Koyama, Kyoto (JP)

(73) Assignee: Seed Company Limited, Osaka (JP)

( * ) Notice: Subject to any disclaimer, the term of this patent is extended or adjusted under 35 U.S.C. 154(b) by 18 days.

(21) Appl. No.: 10/024,308

(22) Filed: Dec. 21, 2001

(65) Prior Publication Data

US 2002/0129719 A1 Sep. 19, 2002

(30) Foreign Application Priority Data

Mar. 14, 2001 (JP) ..... 2001-072096

(51) Int. Cl.[7] ..... B32B 31/00

(52) U.S. Cl. ..... 156/577; 156/579; 118/76; 242/160.4; 242/171; 242/588.6; 206/411; 428/42.3

(58) Field of Search ..... 156/574, 577, 156/579, 523, 527, 538, 540; 118/76, 200, 257; 225/46; 242/160.2, 160.4, 170, 171, 588, 588.2, 588.3, 588.6; 428/42.3

(56) References Cited

U.S. PATENT DOCUMENTS 4,525,237 A * 6/1985 Clar ..... 156/540
4,718,971 A * 1/1988 Summers ..... 156/540
4,880,490 A * 11/1989 MacIntyre ..... 156/541
5,824,379 A * 10/1998 Riley et al. ..... 428/40.1
6,029,849 A * 2/2000 Meshulam ..... 221/26
6,177,163 B1 * 1/2001 Blok et al. ..... 428/40.1
6,394,165 B1 * 5/2002 Rader ..... 156/540
2002/0179242 A1 * 12/2002 Wien ..... 156/344

* cited by examiner

*Primary Examiner*—Mark A. Osele
(74) *Attorney, Agent, or Firm*—Rader, Fishman & Grauer PLLC

(57) ABSTRACT

A mark transfer tool making use of a coat film transfer technology about various marks composed of characters, codes, patterns or their combination. A mark transfer tape is composed of pressure-sensitive adhesive transfer marks disposed and held on the surface of a base tape continuously and peelably at specific intervals, and a bodily sensing recess for showing the division position of transfer marks is disposed between the transfer marks. Corresponding to this configuration, a positioning bump to be engaged with the bodily sensing recess of the mark transfer tape is provided in the tape traveling part of the transfer head, and by reference to the hooking phenomenon in the traveling motion of the mark transfer tape by engagement of the two, the transfer mark on the mark transfer tape can be correctly transferred on the correction area.

28 Claims, 22 Drawing Sheets

MARK TRANSFER TOOL AND MARK TRANSFER TAPE

BACKGROUND OF THE INVENTION

1. Field of the Invention

The present invention relates to a mark transfer tool and a mark transfer tape, and more particularly to a mark transfer technology for transferring a transfer mark in a thin film composed of characters, codes, patterns or their combination arranged and formed on a mark transfer tape, to a sheet of paper or the like.

2. Description of the Related Art

Generally, various marks composed of characters, codes, patterns or their combination are prepared as stamps and impressed on a sheet of paper or other object surface through ink, or prepared as mark seals and adhered to a sheet of paper or the like.

In the background of the recent technical innovation and diversification of users' preferences, widening of product variety is needed in various technical fields, and such trend is not exceptional in the stationery field handling various marks.

BRIEF SUMMARY OF THE INVENTION

It is hence a primary object of the invention to present a novel mark transfer tool and mark transfer tape solving the problems of the prior art.

It is other object of the invention to present a novel mark transfer technology completely different from the conventional mark using technology, about various marks composed of characters, codes, patterns or their combination, by making use of coat film transfer technology.

It is another object of the invention to present a mark transfer tool effectively applicable to diversified preferences of general users, by employing a method of transferring a transfer mark on a mark transfer tape on a sheet of paper or the like.

It is a further object of the invention to present a mark transfer tool using the transfer mark composed of various marks and blank spaces for overwriting, in which various characters can be written over by a writing tool in the blank spaces for overwriting after transfer of transfer marks.

The mark transfer tool of the invention is a tool for transferring a transfer mark on a mark transfer tape on a sheet of paper or the like, comprising a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the correction area, being disposed at the leading end of the case, in which the mark transfer tape has pressure-sensitive adhesive transfer marks disposed and held continuously at specific intervals peelably on the surface of a base tape, and further division bodily sensing means showing division positions of transfer marks is disposed between transfer marks, and bodily sensing engaging parts to be engaged with the division bodily sensing means of the mark transfer tape are disposed on the tape traveling area of the transfer head.

In a preferred embodiment, the following modes may be employed in the division bodily sensing means and bodily sensing engaging parts.

(1) The division bodily sensing means is a bodily sensing sliding part formed between mutually adjacent transfer marks in the mark transfer tape, and the bodily sensing engaging part is the leading edge of the transfer head, and when the bodily sensing sliding part is engaged with the leading edge of the transfer head in the mark transfer operation, a sliding phenomenon occurs in this engaging position, and the transfer complete position of one transfer mark is shown by bodily sensation.

(2) The division bodily sensing means is a bodily sensing recess formed between mutually adjacent transfer marks in the mark transfer tape, and the bodily sensing engaging part is a positioning bump provided on the transfer head, and when the bodily sensing recess is engaged with the positioning bump provided on the transfer head in the mark transfer operation, a hooking phenomenon occurs in the running operation of the mark transfer tape, and the transfer complete position of one transfer mark is shown by bodily sensation.

(3) The division bodily sensing means includes plural bodily sensing bumps formed between mutually adjacent transfer marks in the mark transfer tape, and the bodily sensing engaging part is a positioning bump provided on the transfer head, and when the positioning bump is engaged between the plural bodily sensing bumps in the mark transfer operation, a hooking phenomenon occurs in the running operation of the mark transfer tape, and the transfer complete position of one transfer mark is shown by bodily sensation.

The basic composition of operation of the mark transfer tool is either a refill type having a tape cartridge comprising at least the pay-out reel and take-up reel detachably disposed in the case so that the mark transfer tape may be exchanged, or a onetime type having the pay-out reel and take-up reel disposed in the case, with the transfer head provided at the leading end of the case.

The mark transfer tape of the invention is preferably disposed and used in the mark transfer tool, in which pressure-sensitive adhesive transfer marks are disposed and held continuously at specific intervals peelably on the surface of a base tape, and further division bodily sensing means showing division positions of transfer marks is disposed between transfer marks, and the division bodily sensing means is configured to indicate the division position of one transfer mark by bodily sensation when engaged with the bodily sensing engaging part provided on the transfer head of the mark transfer tool in the mark transfer operation of the mark transfer tool.

In a preferred embodiment, the mark transfer tape of the invention is composed of a transfer mark layer comprising multiple transfer marks adhered and held to the surface side of the base tape of which back side is processed to be peelable, peelably or peelably and detachably in pieces, and more specifically the following lamination structure is employed.

i) The transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape processed to be peelable, peelably and detachably in pieces through the pressure-sensitive adhesive layer.

ii) The transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark forming layer.

iii) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark array layer.

iv) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be adhesive, peelably and detachably in pieces through the mark array layer.

Further, as the division bodily sensing means, the following modes may be employed.

(a) The division bodily sensing means is a bodily sensing sliding part formed of the surface of the base tape between mutually adjacent transfer marks, and when the bodily sensing sliding part is engaged with the leading edge of the transfer head of the mark transfer tool in the mark transfer operation, a sliding phenomenon occurs between the bodily sensing sliding part and the correction area, and the transfer complete position of one transfer mark is shown by bodily sensation.

(b) The division bodily sensing means is a bodily sensing sliding part formed of the surface of the transfer mark layer, corresponding to mutually adjacent transfer marks, and when the bodily sensing sliding part is engaged with the leading edge of the transfer head of the mark transfer tool in the mark transfer operation, a sliding phenomenon occurs between the bodily sensing sliding part and the correction area, and the division position of one transfer mark is shown by bodily sensation.

(c) The division bodily sensing means is a bodily sensing recess formed between mutually adjacent transfer marks on the back side of the base tape, and when the bodily sensing recess is engaged with the bodily sensing engaging part provided on the transfer head of the mark transfer tool in the mark transfer operation, a hooking phenomenon occurs in the running operation of the tape, and the division position of one transfer mark is shown by bodily sensation.

(d) The division bodily sensing means includes plural bodily sensing bumps formed between mutually adjacent transfer marks in the mark transfer tape, and when the bodily sensing engaging part provided on the transfer head of the mark transfer tool is engaged between the plural bodily sensing bumps in the mark transfer operation, a hooking phenomenon occurs in the running operation of the tape, and the transfer complete position of one transfer mark is shown by bodily sensation.

To transfer the transfer mark on the mark transfer tape on a desired correction area of a sheet of paper, the case is held by fingers, the leading end pressing portion of the transfer head is pressed tightly to the correction area, and the case is moved along the sheet of paper in this state, so that the transfer mark is transferred.

Specifically, with the division bodily sensing means provided in the mark transfer tape engaged with the bodily sensing engaging part of the transfer head, the transfer head is tightly pressed to the transfer start end on the correction area, and the case is directly moved along the sheet of paper, and next division bodily sensing means is engaged with the bodily sensing engaging part, and is stopped when a sliding phenomenon occurs in the engaging part or when a hooking phenomenon occurs in the running operation of the mark transfer tape.

By this operation, the transfer mark on the mark transfer tape at the leading end pressing portion of the transfer head is peeled off the base tape, and is accurately transferred on the correction area, and the used mark transfer tape after the transfer mark is separated, that is, the base tape is taken up and collected on the take-up reel.

These and other objects and features of the invention will be more clearly understood by reading the following detailed description taken in conjunction with the accompanying drawings and novel facts disclosed in the claims thereof.

DETAILED DESCRIPTION OF THE PREFERRED EMBODIMENTS

Figure 1:
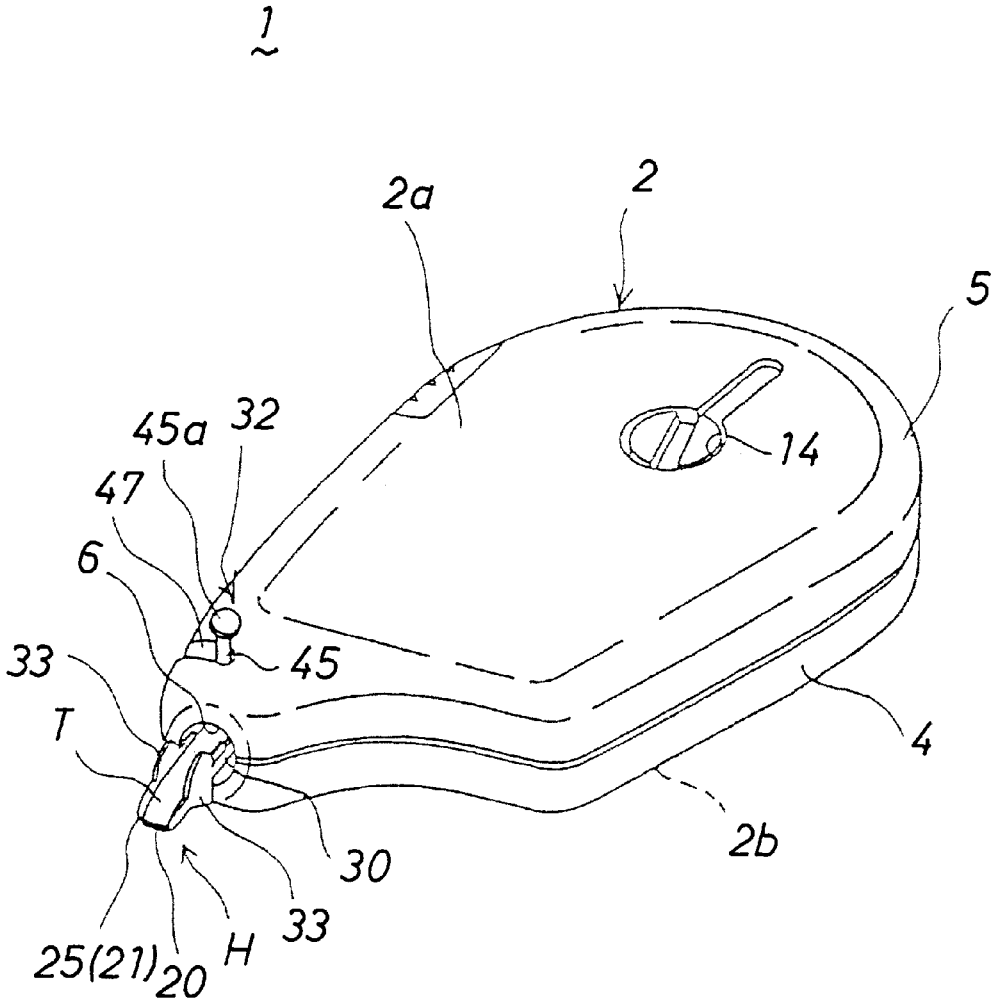
FIG. 1 is a perspective view showing a mark transfer tool in embodiment 1 of the invention.

Referring now to the drawings, preferred embodiments of the invention are described in detail below.

FIG. 1 through FIG. 22 show the mark transfer tool according to the invention, and same reference numerals indicate same constituent members or elements throughout the entire drawings.

Embodiment 1

The mark transfer tool according to this embodiment is shown in FIG. 1 to FIGS. 7A–7C. This mark transfer tool 1 is, specifically, to transfer marks in a thin film combining characters, codes, patterns or their combination arranged and formed on a mark transfer tape T (in the shown example, only a mark composed of alphabetic letters SEED) M, M, . . . , to a sheet of paper or the like, and it is a refill type having a cartridge structure allowing to exchange the mark transfer tape T as a consumable part.

Figure 2:
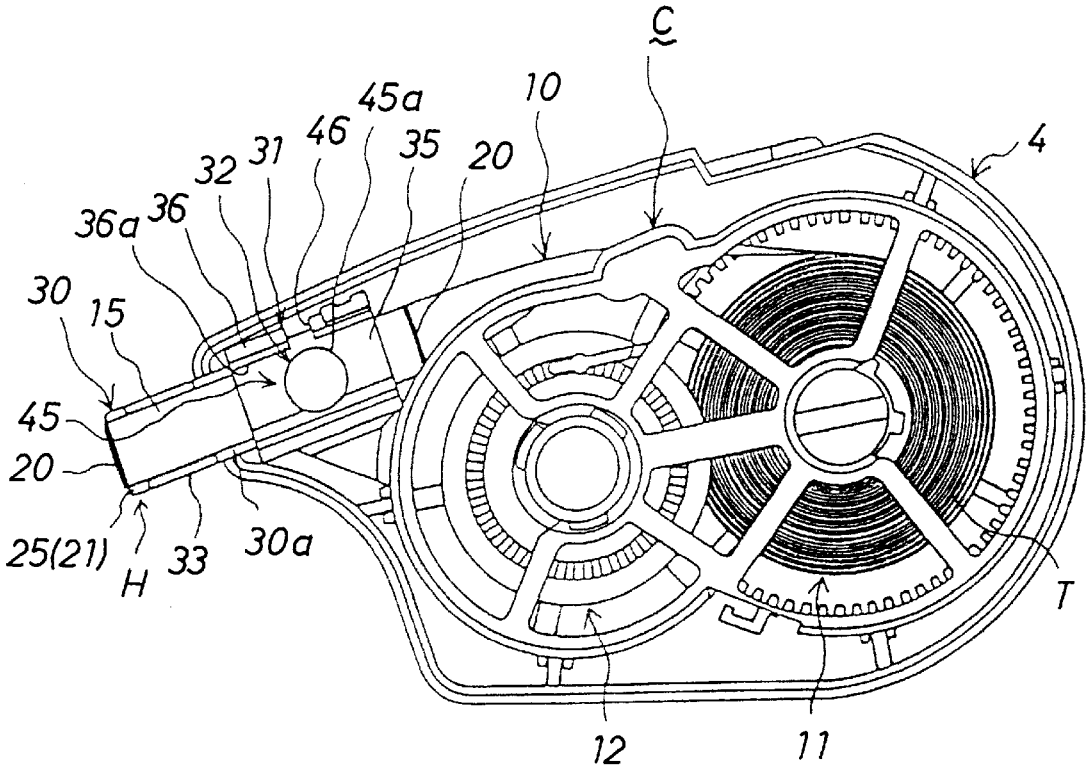
FIG. 2 is a front view showing the inside of a case main body of the mark transfer tool.
Figure 3:
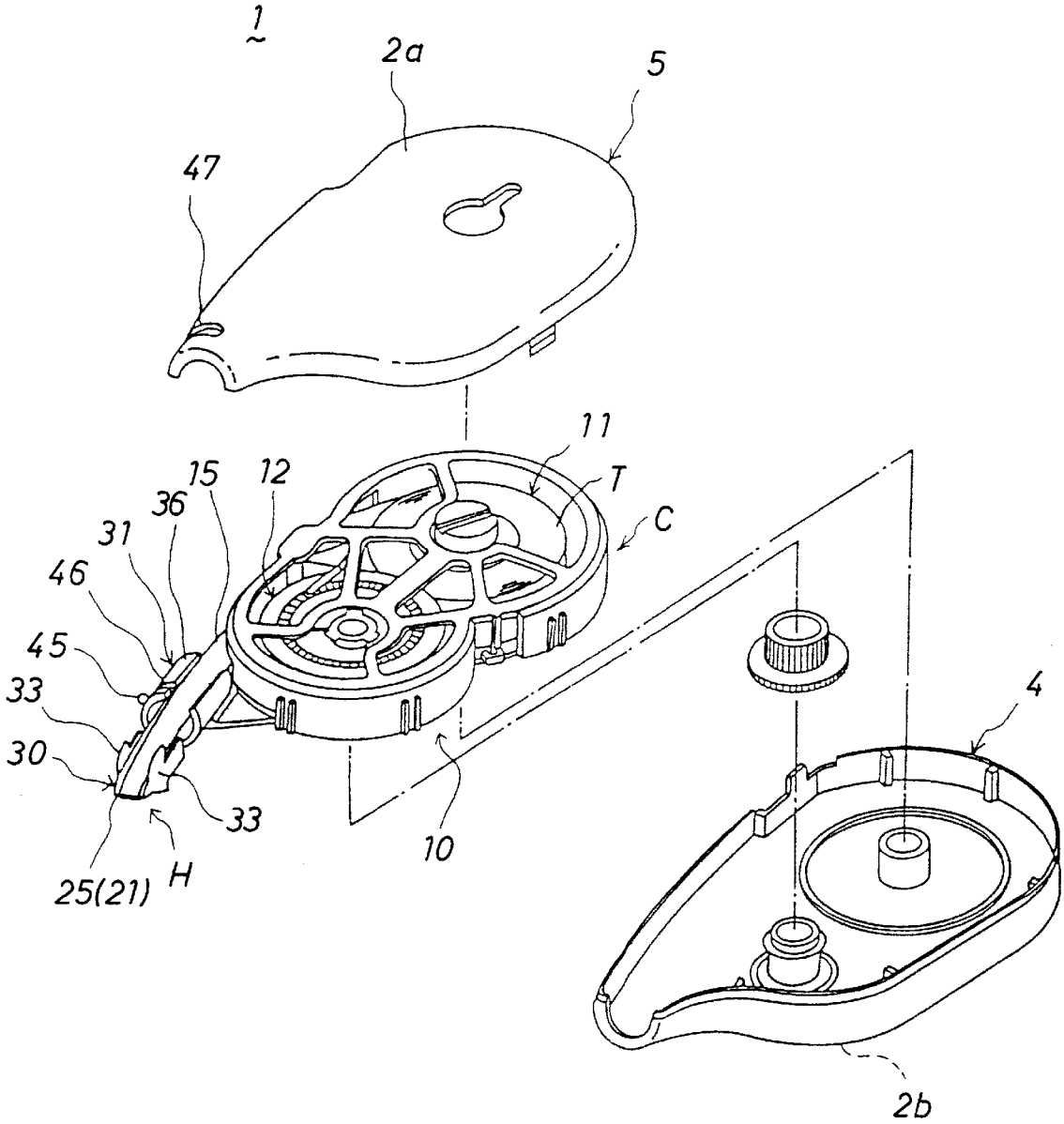
FIG. 3 is a perspective exploded view of the mark transfer tool.

That is, the mark transfer tool 1 comprises a case 2 having an appearance as shown in FIG. 1, and a tape cartridge C having a transfer head H as shown in FIG. 2 and FIG. 3.

The case 2 is held and manipulated by one hand, and is a flat box having a front contour shape and dimension and width enough to incorporate the tape cartridge C, and its confronting pair of flat face and back sides 2*a*, 2*b* are standard gripping sides when holding and manipulating by one hand. The case 2 is a plastic structure integrally formed by injection molding or the like, and a case main body 4 and a cap body 5 are separate, and the tape cartridge is detachably inserted in the case main body 4. At the leading end of the case 2, ahead inserting portion 6 for inserting the transfer head H in and out is formed.

The tape cartridge C is an exchangeable consumable part. The tape cartridge C consists of a pay-out reel 11 on which a mark transfer tape T is wound, and a rotatable take-up reel 12 for collecting the mark transfer tape T after use, which are rotatably installed in a cartridge case 10, and further a transfer head H for pressing and transferring the mark transfer tape to the correction area is installed rotatably about the head axial center.

Although not specifically shown in the drawing, the tape cartridge C further includes a tape interlocking unit for mutually interlocking the pay-out reel 11 and take-up reel 12, a clutch mechanism for synchronizing the pay-out speed and take-up speed of the mark transfer tape T in the pay-out reel 11 and take-up reel 12, and other principal and basic components, which are assembled as a unit.

The cartridge case 10 is made of synthetic resin in a form of a cartridge case for accommodating the both reels 11, 12, and its shape and dimensions are set to be lightweight and compact in a range of having holding functions of both reels 11, 12, and more specifically it is a skeletal structure mainly composed of thin skeletal members.

The mark transfer tape T is to supply transfer marks M continuously, and pressure-sensitive adhesive transfer marks M are disposed and held on the surface of a base tape 15 continuously and peelably at specified intervals. Between the transfer marks M, M, division bodily sensing means 20 showing the division position of transfer marks M is disposed, and corresponding to this, at the tape traveling part of the transfer head H, a bodily sensing engaging part 21 to be engaged with the division bodily sensing means 20 is provided.

Figure 5A:
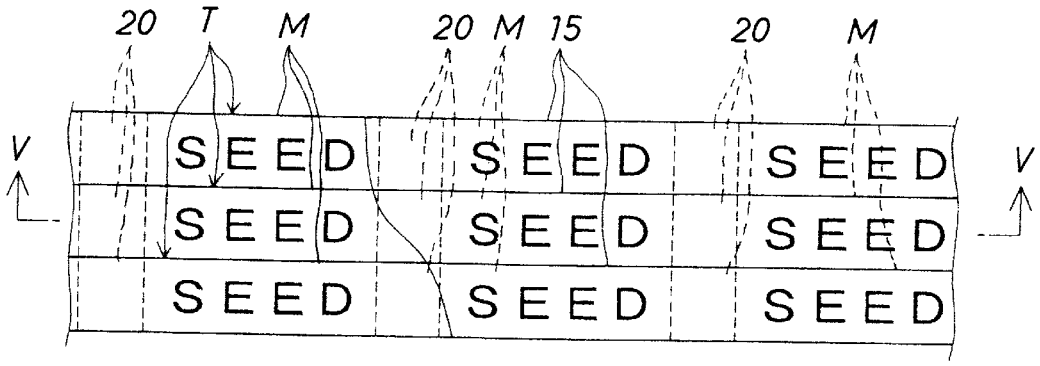
FIG. 5A is a plan of mark transfer tool of the mark transfer tool, showing a partially cut-away view of the mark transfer tape in the manufacturing process.
Figure 5B:
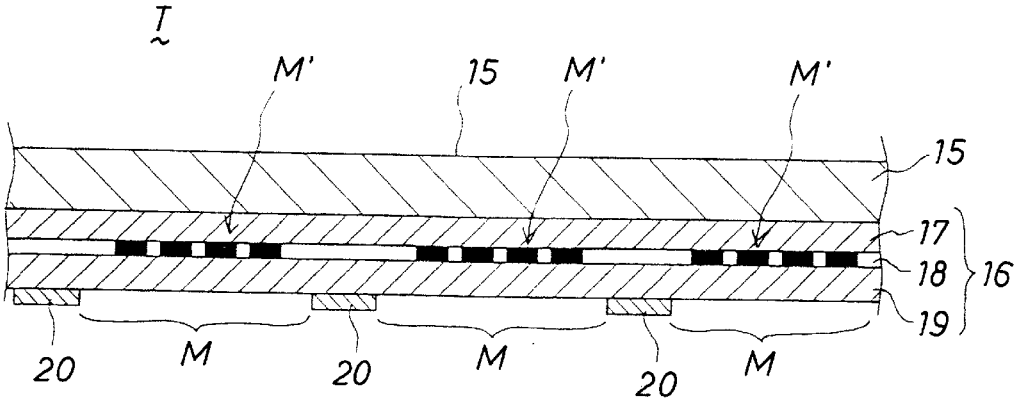
FIG. 5B is a sectional view along line V—V in FIG. 5A of the mark transfer tape.
Figure 5C:
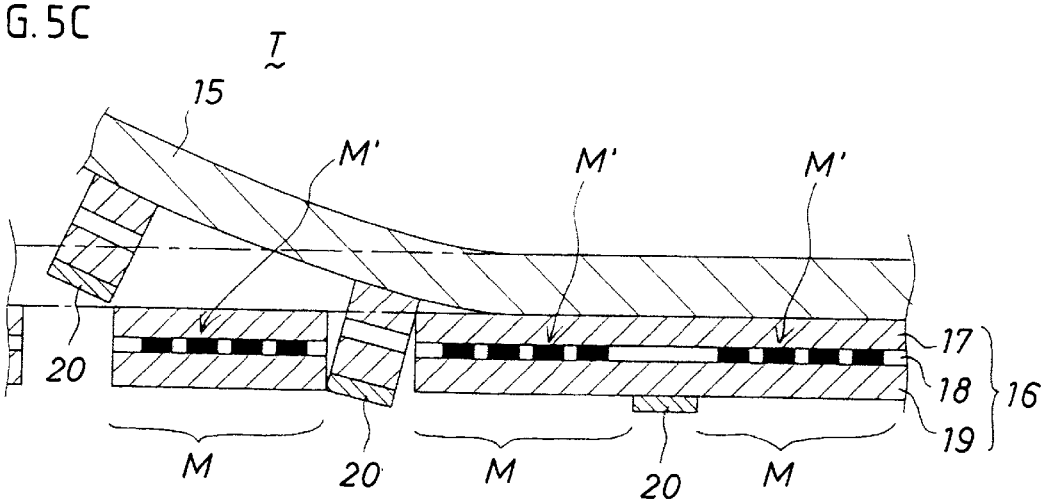
FIG. 5C is a sectional view showing a peeling state of base tape and transfer mark layer of the mark transfer tape.

In the shown embodiment, the mark transfer tape T has a sectional structure as shown in FIG. 5, and on the surface of the base tape 15 (the lower side in FIG. 5B and FIG. 5C), a transfer mark layer 16 composed of multiple transfer marks M, M, . . . is peelably adhered and held. Since the drawings are intended to help understanding, they are schematic and magnified in the thickness direction, but actually the mark transfer tape T is a thin film, and the boundary of layers is not so clear as illustrated.

The base tape 15 has its both face and back sides processed to be peelable, that is, it is a film tape made of plastic or paper material, having the surface treated to be separable or peelable from the adjacent layers or materials, and a non-stretchable flexible film is preferably used.

The transfer mark layer 16 is a laminate structure integrally laminating a mark forming layer 17, a mark array layer 18, and a pressure-sensitive adhesive layer 19. This transfer mark layer 16 is continuous over the overall length of the base tape 15, that is, the transfer marks M, M, . . . are formed continuously, and are properly cut off by transfer operation of the transfer head H at the time of mark transfer.

The mark forming layer 17 is intended to facilitate formation (specifically printing) of mark array layer 18, and has a function of adhering and holding the transfer mark layer 16 on the surface of the base tape 15, and a surface layer is formed after transfer of transfer mark M. The mark forming layer 17 is made of an adhesive transparent material. That is, the mark forming layer 17 is preferably made of a transparent see-through resin material of dry type suited to surface layer after parting, having a proper adhesion holding property on the parted surface of the base tape 15.

The mark array layer 18 is composed of multiple marks (in the shown example, only a mark composed of alphabetic letters SEED) M', M', M', . . . arranged continuously and peelable at specific intervals in the running direction of the base tape 15, and is specifically formed on the mark forming layer 17 by a known printing technology.

The printing method of the mark array layer 18 includes various known printing techniques, specifically, typographic (relief) printing, offset printing, gravure (intaglio) printing, or silk screen printing, and further novel printing techniques such as laser printer, heat transfer, and ink jet printer systems, which may be properly selected depending on the properties of the forming object area (in the shown case, the mark forming layer 17).

The pressure-sensitive adhesive layer 19 is used to press and adhere the transfer mark layer 16 to the correction area, and to form a surface layer of mark transfer tape T before transfer, and this pressure-sensitive adhesive layer 19 is made of a pressure-sensitive transparent material. That is, the pressure-sensitive adhesive layer 19 is preferably made of a transparent see-through adhesive material of dry type suited to a surface layer before parting, having a pressure-sensitive adhesion to the correction area.

Such laminated transfer mark layer 16 is, as shown in FIG. 5, adhered and held on the surface (the lower side in FIG. 5B and FIG. 5C) of the base tape 15 processed for parting, peelably and separably through the mark forming layer 17.

The division bodily sensing means 20 is specifically, as shown in FIG. 5, a bodily sensing sliding part printed and formed on the surface (the lower side in FIG. 5B and FIG. 5C) of the transfer mark layer 16, and its printing method is one of various conventional printing techniques same as in the case of the mark array layer 18.

This bodily sensing sliding part 20 is formed corresponding to the mutually adjacent transfer marks M, M of the transfer mark layer 16, and is formed, for example, by known printing process on the surface of the pressure-sensitive adhesive layer 19 in the transfer mark layer 16.

This bodily sensing sliding part 20 has the same sliding characteristics as the parting process applied to the surface and back sides of the base tape 15, covers the surface of the pressure-sensitive adhesive layer 19 to extinguish the pressure adhesion of this portion on the correction area. This bodily sensing sliding part 20 is made of a transparent parting material same as the mark forming layer 17 and pressure-sensitive adhesive layer 19.

The specific forming position of the bodily sensing sliding part 20 is set corresponding to the bodily sensing engaging part 21 of the transfer head H, and is set so as to indicate the division position of one transfer mark M, or the transfer completion position in the shown embodiment, by bodily sensation, when the bodily sensing sliding part 20 is engaged with the bodily sensing engaging part 21 in the mark transfer operation of the mark transfer tool 1 mentioned below to cause a sliding phenomenon in the engaging position.

The bodily sensing engaging part 21 corresponding to the bodily sensing sliding part 20 is set at the tape traveling part of the transfer head H, and the leading edge of the transfer head, that is, the leading end pressing portion 25 functions also as the bodily sensing engaging part 21.

Figure 4A:
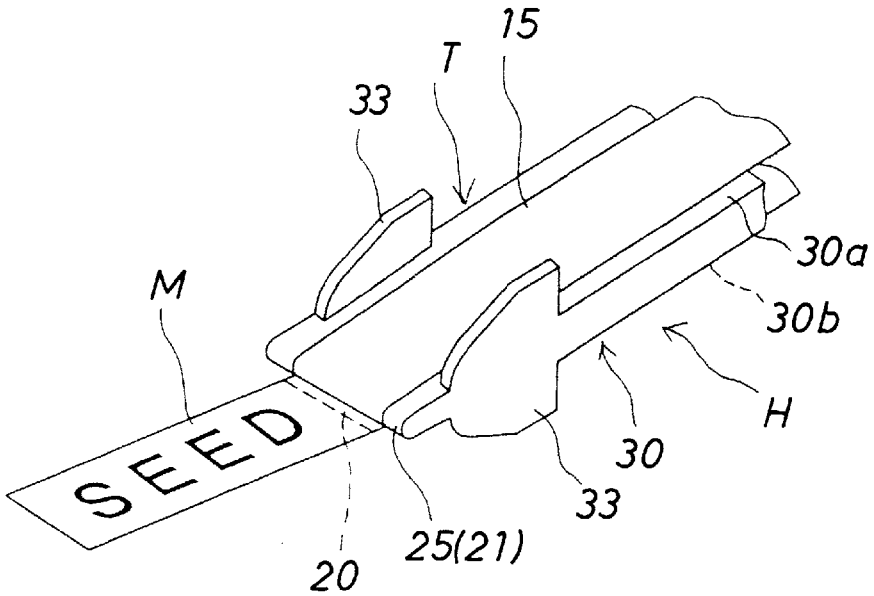
FIG. 4A is a perspective view showing essential parts of transfer head of the mark transfer tool.
Figure 4B:
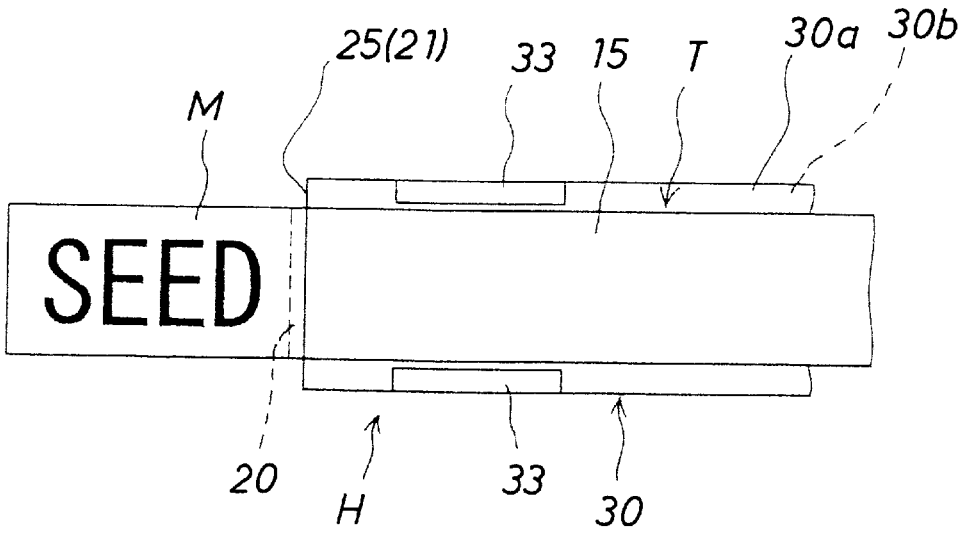
FIG. 4B is a plan showing essential parts of transfer head of the mark transfer tool.

That is, the mark transfer tape T paid out from the pay-out reel 11 is guided into the leading end pressing portion 25 along the tape traveling surface at one side of the transfer head H, and passes through the leading end pressing portion 25 and is inverted, and is further guided along the tape traveling surface of the opposite side, and taken up on the take-up reel 12, and as shown in FIG. 4A and FIG. 4B, the transfer completion position of one transfer mark M is indicated by bodily sensation when the bodily sensing sliding part 20 of the mark transfer tape T is engaged with the leading end pressing portion 25 (21) of the transfer head H to cause a sliding phenomenon in the engaging position.

More specifically, when the bodily sensing sliding part 20 of the mark transfer tape T is engaged with the leading end pressing portion 25 (21) of the transfer head H, sliding occurs between the bodily sensing sliding part 20 and the correction area, and running of the mark transfer tape T is stopped, and the mark transfer action is disabled, so that the user knows the transfer complete position of one transfer mark M by bodily sensation. To start transfer action of next transfer mark M, as mentioned below, while pressing the leading end pressing part 25 of the transfer head H somewhat firmly on the correction area preliminarily, by moving on the correction area, running of the mark transfer tape T is started again, so that the mark transfer action is enabled.

The mark transfer tape T in the shown embodiment is manufactured as a band having a tape width corresponding to plural mark transfer tapes T, T, . . . as shown in FIG. 5A, and cut and formed in a width of one tape T by slitter or other cutting device.

According to a specific forming method of the transfer mark layer 16, the mark forming layer 17 is applied and formed on the surface of the base tape 15, the mark array layer 18 is printed and formed on the surface of the mark forming layer 17, and the pressure-sensitive adhesive layer 19 is applied and formed thereon, and finally the bodily sensing sliding part 20 is printed and formed on the pressure-sensitive adhesive layer 19.

The transfer head H presses the mark transfer tape T to a correction area on a sheet of paper, and it is disposed at the leading end of the cartridge case 10, and has a function of guiding the mark transfer tape T and a function of pressing.

A specific structure of the transfer head H comprises a head main body 30, a head holding portion 31, and a rotary operation portion 32. The head main body 30 is held rotatably about its axial center, that is, a so-called rotary head structure is formed.

The head main body 30 is to press and transfer the mark transfer tape T, and is shaped to be suited to transfer accurately to a desired transfer position, that is, in a pointed form.

The head main body 30 in the shown example is a thin plate having a rectangular shape slightly wider than the mark transfer tape T, and has a taper section, being pointed in a side view so as to be gradually thin toward the leading end. The head main body 30 has flat both side surfaces 30*a*, 30*b*, which form tape traveling surfaces, and a leading edge 25 is a leading end pressing portion for pressing the mark transfer tape T as mentioned above and also functions as the bodily sensing engaging part 21. This leading end pressing portion 25 is a straight edge orthogonal to the tape traveling direction in the tape traveling surfaces 30*a*, 30*b*. At both side edges of the head main body 30, guide flanges 33, 33 are formed for guiding running of mark transfer tape T.

If the thickness of the plate for composing the head main body 30 is relatively small, tapering as shown in the drawing is not always necessary, but the plate thickness may be uniform throughout the longitudinal direction, and anyway the structure is not particularly specified as far as the leading end of the pressing portion of the head main body 30 has a thickness (a point) enough to position and indicate the transfer position accurately.

At the base end side portion of the head main body 30, further, a borne portion 35 is integrally formed as a main body support.

The head holding portion 31 supports the head main body 30 rotatably bout its axial center, and specifically comprises a borne portion 35 as the main body support, and a bearing 36 provided in the cartridge case 10.

Figure 6A:
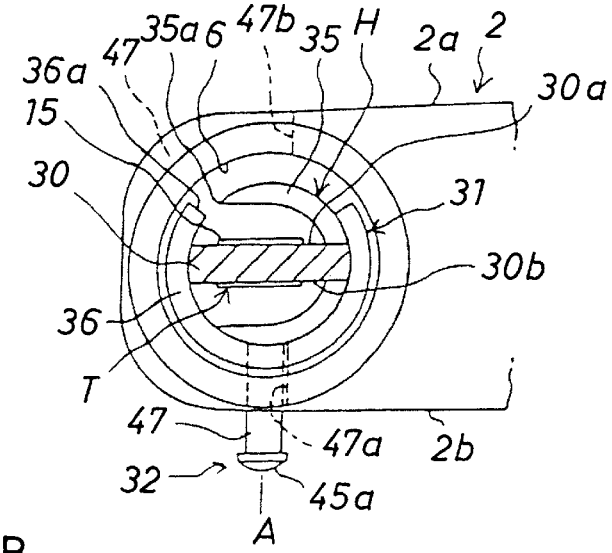
FIGS. 6A, 6B, and 6C are a magnified front view showing a partial section of rotating structure of transfer head for the mark transfer tool.
Figure 6B:
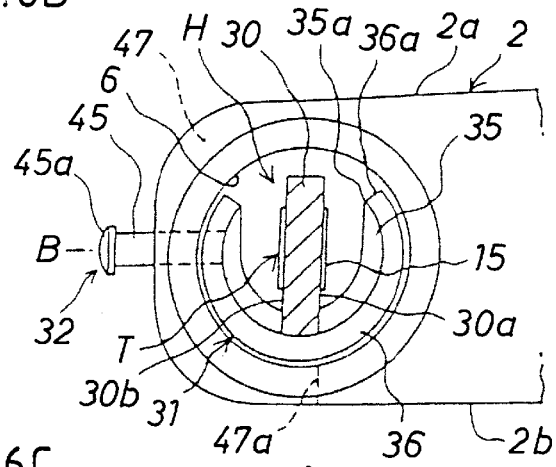
Figure 6C:
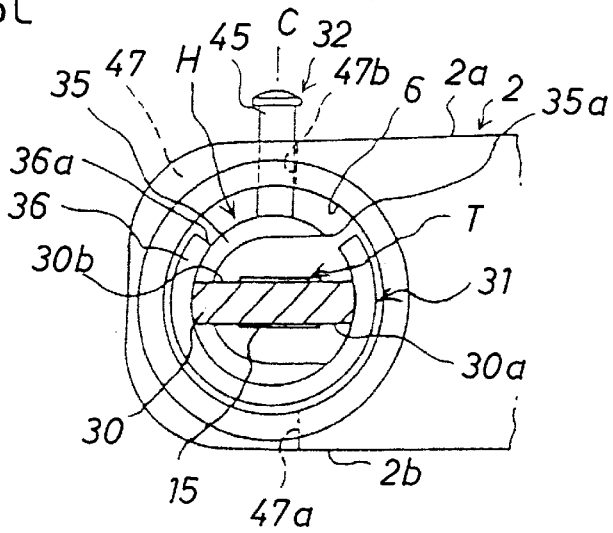

The borne portion 35 is, as shown in FIGS. 6A–6C, a cylindrical portion provided concentrically and integrally with the head main body 30, and more specifically it is formed in an arc section having a setting opening 35*a* of mark transfer tape T to the head main body 30 in a part thereof.

The bearing 36 is disposed integrally at the leading end of the cartridge case 10. As shown in FIGS. 6A–6C, the bearing 36 is tubular having an inner circumference corresponding to the outer circumference of the borne portion 35, and same as the borne portion 35, it is formed in an arc section having a setting opening 36*a* of mark transfer tape T to the head main body 30 in a part thereof. The born portion 35 is slidably supported on the bearing 36, and the head main body 30 is freely rotatable about the axial center in a specified rotating angle range described below.

The rotary operation portion 32 is to determine the rotating direction position of the head main body 30, and also serves as head position indicator to show the tape pressing and transferring position of the head main body 30.

The rotary operation portion 32 is a circular bar, and has an operation lever 45 including an operation knob 45*a* disposed at its leading end as a principal unit. The operation lever 45 is extended linearly outward in the radial direction from the axial center of the born portion 35, and projects to the outside of the case 2, through a slit inserting portion 46 and an operation guide portion 47 disposed at corresponding positions in the bearing 36 and case 2. In this case, the inserting portion 46 of the bearing 36 functions as a locking portion of the head main body 30 to prevent it from slipping out in the axial direction.

The location of the operation lever 45 in the rotating direction with respect to the head main body 30 is set in relation to the tape pressing and transferring position of the head main body 30, and the slit inserting portion 46 and operation guide portion 47 are extended in the peripheral direction so as to allow moving of the operation lever 45 in the rotating direction of the head main body 30. In particular, the operation guide portion 47 of the case 2 defines the operating range in the rotating direction of the operation lever 45, and is configured to control the tape pressing and transferring position of the head main body 30.

The relation of the operation lever 45 and the tape pressing and transferring position of the head main body 30 is explained with respect to the operation guide portion 47. In the shown embodiment, the configuration of the operation guide portion 47 as the operation range defining portion in the rotating direction is set follows, referring to FIGS. 6A–6C.

(a) When the operation lever 45 is in contact with one end 47*a* of the operation guide portion 47, that is, in the vertical downward position (first defined position A shown in FIG. 6A), the head main body 30 of the transfer head H is located at an angular position for guiding its leading end pressing portion 25 so that the mark transfer tape T may be nearly opposite to the gripping surfaces 2*a*, 2*b* of the case 2, that is, the face and back sides of the mark transfer tape T may be directed nearly in the same direction as (parallel to) the gripping surfaces 2*a*, 2*b*.

Figure 7A:
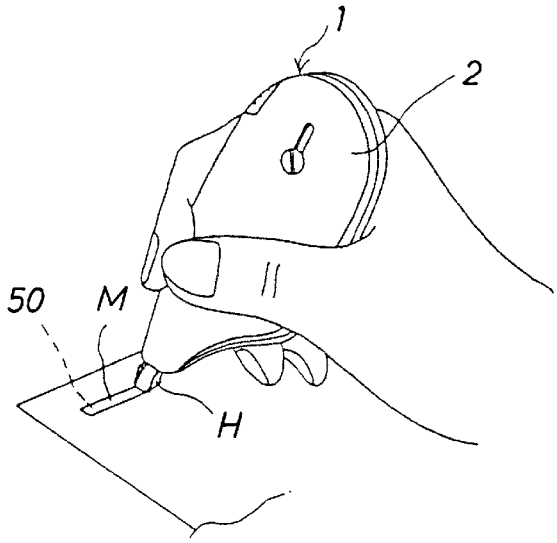
FIG. 7A is a perspective view of state of use of the mark transfer tool, showing a state of use of lateral pull by the right hand.

In this case, the new mark transfer tape T rolled out from the pay-out reel 11 is at the lower side of the head main body 30, and is in a state suited to use by lateral pull by a right-handed user (see FIG. 7A).

(b) When the operation lever 45 is at an intermediate position between both ends 47*a*, 47*b* of the operation guide portion 47, that is, in the horizontal downward position (second defined position B shown in FIG. 6B), the head main body 30 of the transfer head H is located at an angular position for guiding its leading end pressing portion 25 so that the mark transfer tape T may remain in wound state on the pay-out reel 11 and take-up reel 12, that is, the face and back sides of the mark transfer tape T may be directed nearly in a nearly vertical direction (orthogonal) to the gripping surfaces 2*a*, 2*b*.

Figure 7B:
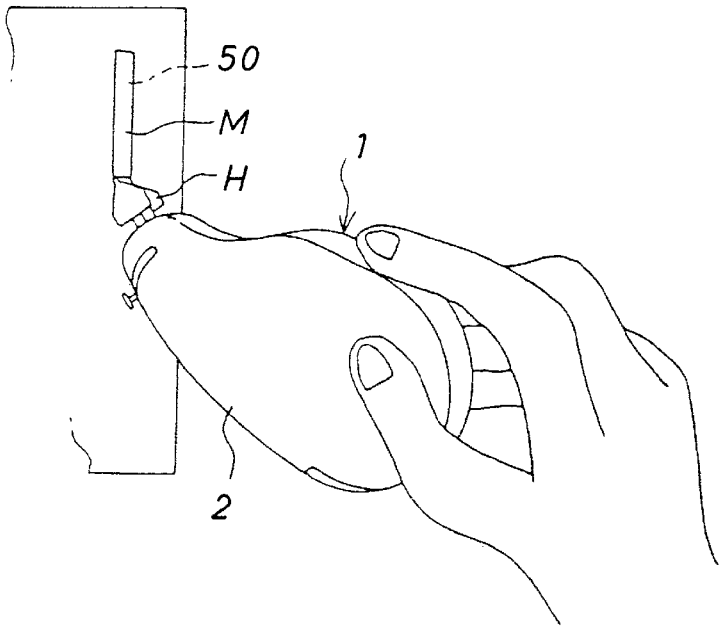
FIG. 7B is a perspective view of state of use of the mark transfer tool, showing a state of use of lateral pull by the left hand.

In this case, the new mark transfer tape T rolled out from the pay-out reel 11 is at the left side of the head main body 30, and is in a state suited to use by vertical pull (see FIG. 7B).

(c) When the operation lever 45 is in contact with other end 47*b* of the operation guide portion 47, that is, in the vertical upward position (third defined position C shown in FIG. 6C), the head main body 30 of the transfer head H is located at an angular position for guiding its leading end pressing portion 25 so that the mark transfer tape T may be nearly opposite to the gripping surfaces 2*a*, 2*b* of the case 2, in the upside down state of the case (a) above.

Figure 7C:
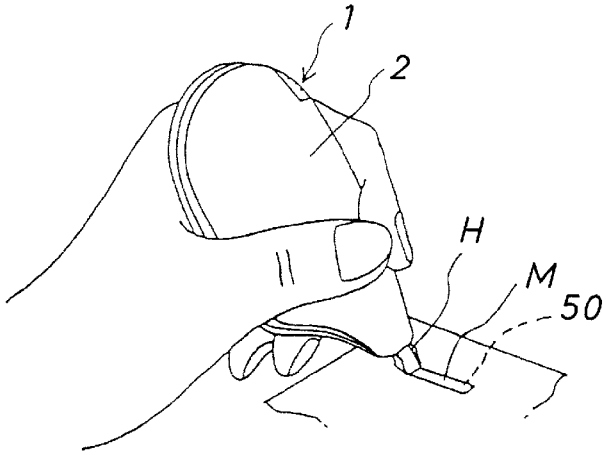
FIG. 7C is a perspective view of state of use of the mark transfer tool, showing a state of use of vertical pull by the right hand.

In this case, the new mark transfer tape T rolled out from the pay-out reel 11 is at the upper side of the head main body 30, and is in a state suited to use by lateral pull by a left-handed user (see FIG. 7C).

As clear from the description above, the direction of the operation lever 45 directly and visually shows the opposite direction of the new mark transfer tape T (function as head position indicator), and the user can confirm the tape pressing and transferring position of the head main body 30 by referring to the direction of the operation lever 45.

The rotating direction operating range of the operation guide portion 47 (nearly 180° at maximum in shown example) can be set in various desired values from a small angle range to a large angle range in consideration of relation between the operation lever 45 and the tape pressing and transferring position of the head main body 30.

Using the mark transfer tool 1 having such configuration, to transfer the transfer mark on the mark transfer tape onto a desired correction area 50 on a sheet of paper or the like, whether the user is right-handed or left-handed as mentioned above, the operation lever 45 can be rotated according to the purpose, and an optimum tape pressing and transferring position of the head main body 30 of the transfer head H (typically, first defined position A shown in FIG. 6A, second defined position B shown in FIG. 6B, or third defined position C shown in FIG. 6C) can be selected and set, and corresponding to this position, the case 2 can be gripped by fingers on the gripping surfaces (standard gripping surfaces are face and back sides 2*a*, 2*b* of the case 2, but proper positions or sides of the case 2 may be gripped depending on the purpose), so that various methods of use, for example, as shown in FIGS. 7A to 7C may be possible.

That is, in any method of use, the gripping surfaces of the case 2 are held like holding a writing tool, and the leading end pressing portion 25 of the transfer head H is pressed tightly to the transfer start end of the correction area 50 on a sheet of paper or the like, and the case 2 is moved along the sheet of paper by a specified distance and stopped.

More specifically, with the bodily sensing part 20 provided in the mark transfer tape T being engaged with the bodily sensing engaging part 21 of the transfer head H, that is, the leading end pressing portion 25, in other words, in the complete state of the previous mark transfer action, the transfer head H is tightly pressed to the transfer start end on the correction area 50, and the case 2 is directly moved along the sheet of paper, and is stopped when the next bodily sensing sliding part 20 is engaged with the bodily sensing engaging part 21 to cause a sliding phenomenon in the engaging position.

That is, as mentioned above, when the bodily sensing sliding part 20 of the mark transfer tape T is engaged with the leading end pressing portion 25 of the transfer head H, sliding occurs between the bodily sensing sliding part 20 and the correction area 50, and running of the mark transfer tape T is stopped, and the mark transfer action is disabled, so that the user knows the transfer complete position of one transfer mark M by bodily sensation.

By this operation, the transfer mark M of the mark transfer tape T in the leading end pressing portion 25 of the transfer head is peeled from the base tape 15, and transferred onto the correction area 50, and the used mark transfer tape T after the transfer mark M is peeled off, that is, the base tape 15 is taken up and collected on the take-up reel 12. In this case, the portion of the transfer mark layer 16 having the bodily sensing sliding part 20 is not adhered to the correction area 50, but is left over on the base tape 15.

To start transfer action of next transfer mark M from this state, while pressing the leading end pressing part 25 of the transfer head H somewhat firmly on the correction area 50 preliminarily, by moving on the correction area, running of the mark transfer tape T is started again, so that the mark transfer action is enabled.

Since the mark transfer tool 1 of the embodiment has a cartridge structure for exchanging the mark transfer tape T, various transfer marks M, M, . . . depending on the purpose of use can be transferred and used by preparing a plurality of tape cartridges C having mark transfer tapes T of plural types of transfer marks M, M . . . .

Embodiment 2

Figure 8A:
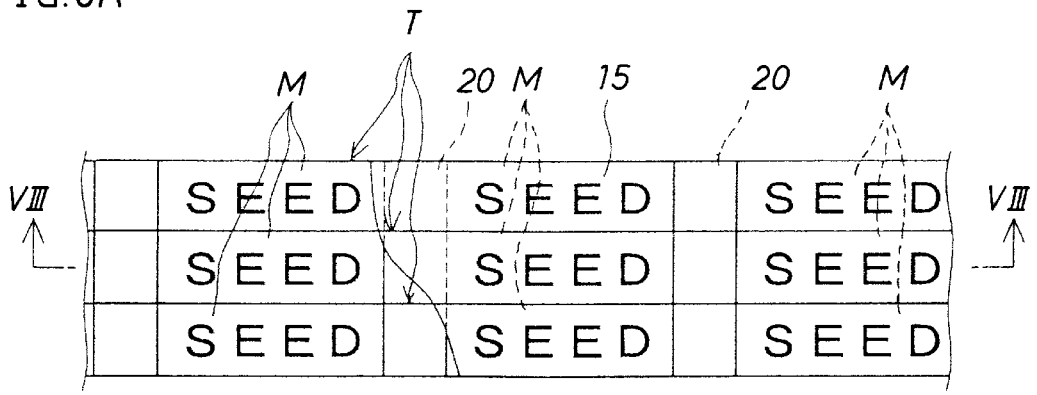
FIG. 8A is a plan of mark transfer tape of a mark transfer tool according to embodiment 2 of the invention, showing a partially cut-away view of the mark transfer tape in the manufacturing process.
Figure 8B:
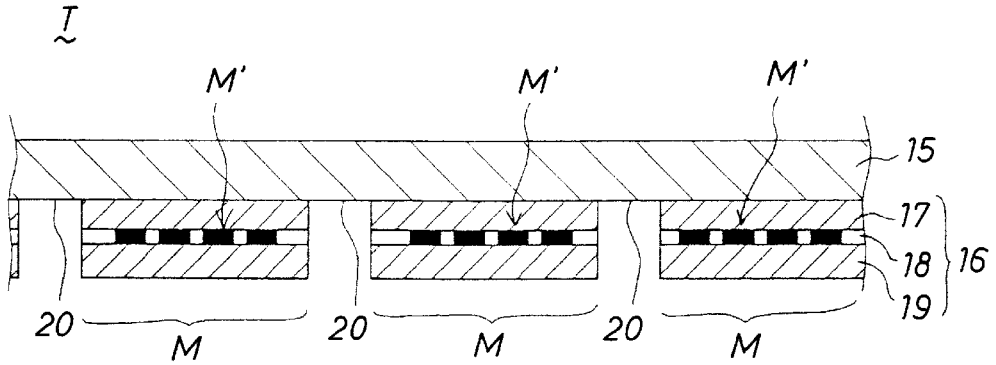
FIG. 8B is a sectional view along line VIII—VIII in FIG. 8A of the mark transfer tape.
Figure 8C:
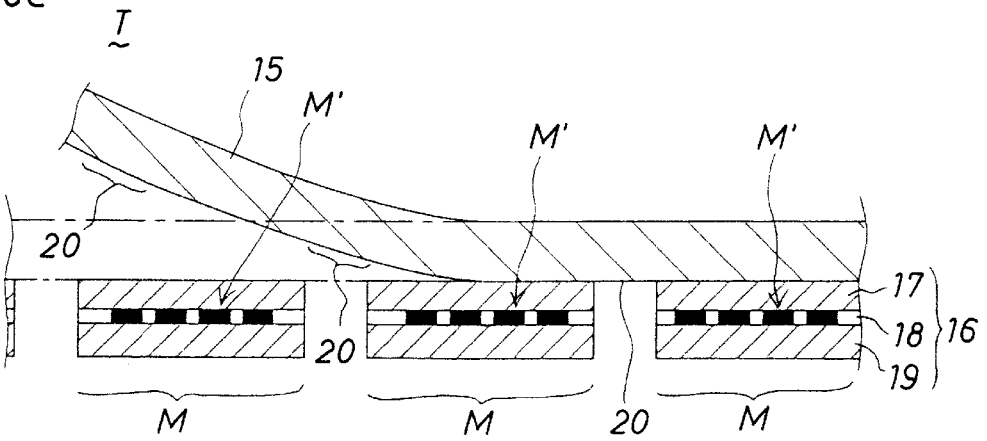
FIG. 8C is a sectional view showing a peeling state of base tape and transfer mark layer of the mark transfer tape.

This embodiment is shown in FIGS. 8A–8C, in which the structure of the mark transfer tape Tin embodiment 1 is modified.

That is, in the mark transfer tape T of embodiment 1, as mentioned above, the transfer mark layer 16 is formed continuously over the entire length of the base tape 15, whereas in the mark transfer tape T of this embodiment, as shown in FIG. 8, transfer marks M, M, . . . composing the transfer mark layer 16 are peelably adhered and held on the surface of the base tape 15 independently and at specific intervals.

The bodily sensing sliding part 20 is composed of the surface of the base tape 15 between the mutually adjacent marks M, M in the mark transfer layer 16.

In this configuration, by the same transfer operation as explained in embodiment 1, with the bodily sensing sliding part 20 being engaged with the bodily sensing engaging part 21 of the transfer head H, the leading end pressing portion 25 of the transfer head H is tightly pressed at the transfer start end of the correction area 50 on the sheet of paper, and the case 2 is directly moved along the sheet of paper, and is stopped when a sliding phenomenon occurs in the engaging position as the next bodily sensing sliding part 20 is engaged with the bodily sensing engaging part 21.

By this operation, only one transfer mark M of the mark transfer tape T is peeled from the base tape 15, and is transferred on the correction area 50.

To start transfer action of next transfer mark M from this state, while pressing the leading end pressing part 25 of the transfer head H somewhat firmly on the correction area 50 preliminarily, by moving on the correction area, running of the mark transfer tape T is started again, so that the mark transfer action is enabled.

The other configuration and operation are same as in embodiment 1.

Embodiment 3

Figure 9A:
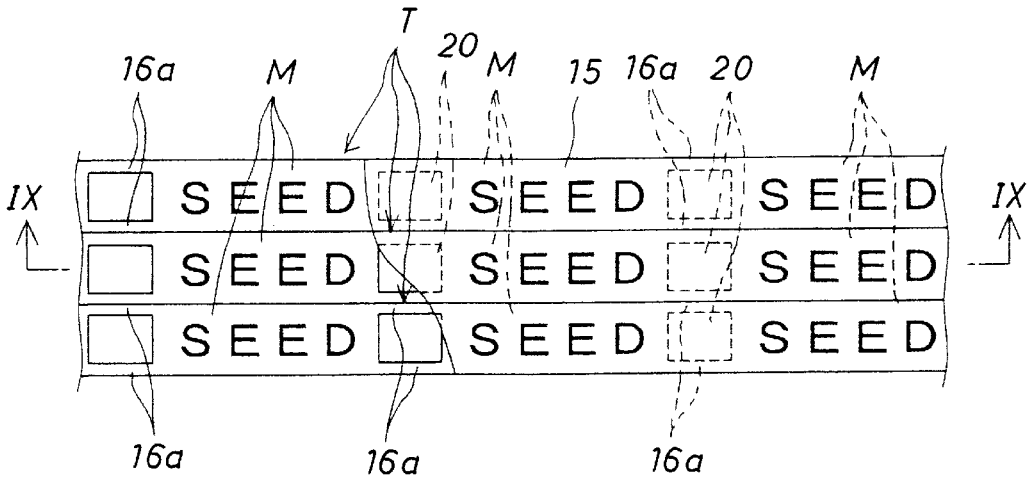
FIG. 9A is a plan of mark transfer tape of a mark transfer tool according to embodiment 3 of the invention, showing a partially cut-away view of the mark transfer tape in the manufacturing process.
Figure 9B:
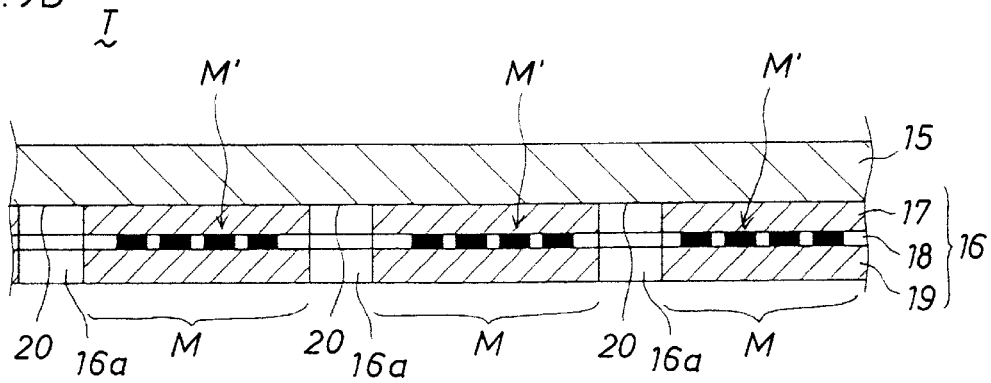
FIG. 9B is a sectional view along line IX—IX in FIG. 9A of the mark transfer tape.
Figure 9C:
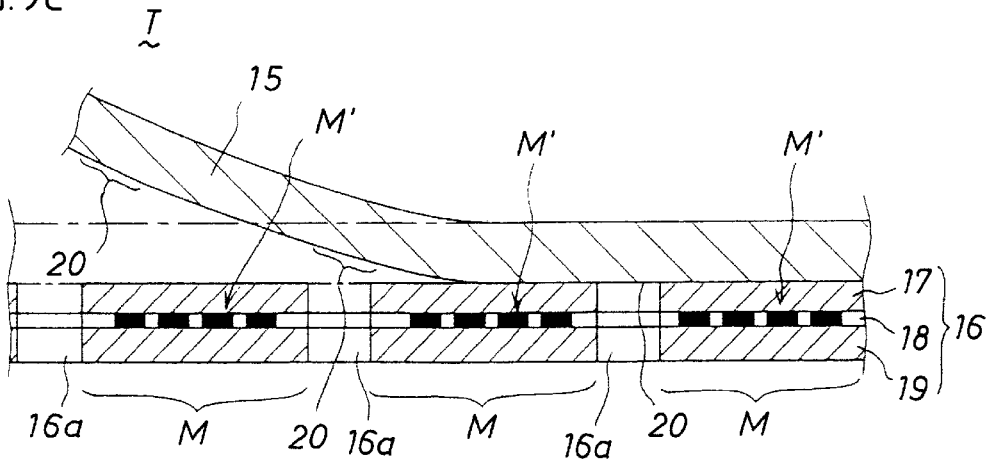
FIG. 9C is a sectional view showing a peeling state of base tape and transfer mark layer of the mark transfer tape.
Figure 10A:
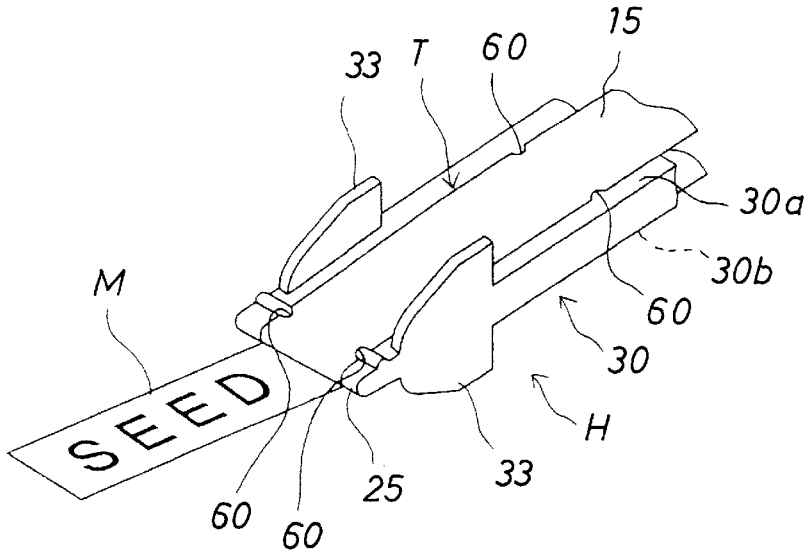
FIG. 10A is a perspective view showing essential parts of transfer head of mark transfer tool according to embodiment 4 of the invention.
Figure 10B:
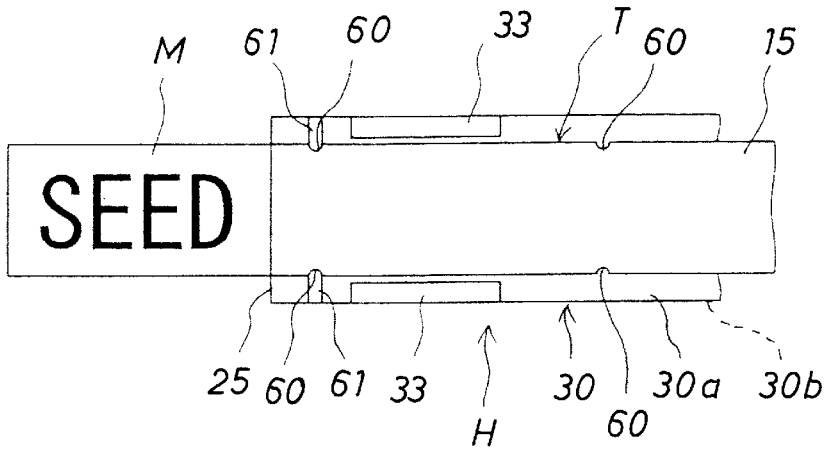
FIG. 10B is a plan showing essential parts of the transfer head.
Figure 10C:
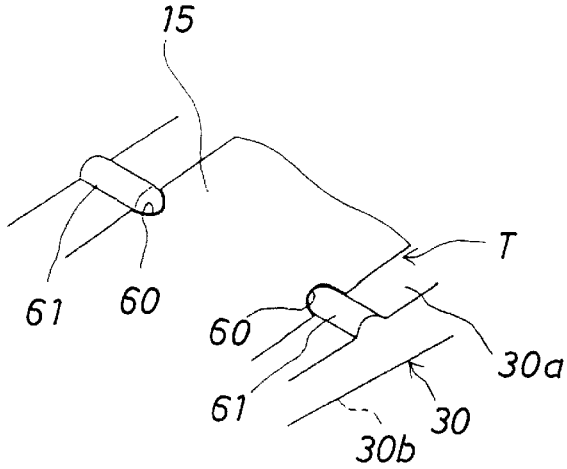
FIG. 10C is a partially magnified perspective view of essential parts of the transfer head.

This embodiment is shown in FIGS. 9A–9C, in which the structure of the mark transfer tape T in embodiment 2 is modified.

That is, in the mark transfer tape T of the embodiment, transfer marks M, M, . . . composing the transfer mark layer 16 are peelably adhered and held on the surface of the base tape 15 independently and at specific intervals, and these transfer marks M, M are mutually coupled by means of a thin coupling layer 16*a*. The specific layer structure of this coupling layer 16*a* is same as that of the transfer mark layer 16, and is transparent. In the illustrated embodiment, the transfer marks M, M are mutually coupled by means of two thin coupling layers 16*a*, 16*a* at both side edges in the width direction.

The bodily sensing sliding part 20 is, same as in embodiment 2, composed of the surface of the base tape 15 between the mutually adjacent marks M, M in the mark transfer layer 16.

In this configuration, the transfer operation is same as in embodiment 2, but the transfer start action is easier when transferring a next transfer mark M after transferring one transfer mark M.

That is, since the mutually adjacent transfer marks M, M are coupled by means of two coupling layers 16*a*, 16*b*, when the bodily sensing sliding part 20 being engaged with the leading end pressing portion 25 of the transfer head H, sliding occurs between the bodily sensing sliding part 20 and correction area 50, part of the two coupling layers 16*a*, 16*a* is left over on the base tape 15 of the mark transfer tape T.

When starting transfer action of next transfer mark M, the remaining portion of the coupling layers 16*a*, 16*b* promotes restarting of running without causing sliding on the mark transfer tape T, so that the mark transfer action may be smoothly and securely started again.

The other configuration and operation are same as in embodiment 2.

Embodiment 4

This embodiment is shown in FIGS. 10A–10C and FIGS. 11A–11C, in which the specific structure of the mark transfer tape T in embodiment 1 is slightly modified.

That is, in the mark transfer tape T of this embodiment, division bodily sensing means 60 is a bodily sensing recess formed between mutually adjacent transfer marks M, M, and specifically it is a notch formed at least at one end in the width direction of the mark transfer tape T (both ends in the shown case). This notch 60 formed in an arc shape (semicircular in this case) in order to prevent breakage of the base tape 15 due to stress concentration.

Corresponding to this, a bodily sensing engaging part 61 provided in the transfer head H is a positioning bump so as to be engaged with the notch 60 in convex-concave relation.

This positioning bump 61 is provided at both sides in the width direction of the tape traveling surface 30*a* of the upper side for guiding running of used mark transfer tape T, that is, the base tape 15, of the tape traveling surfaces 30*a*, 30*b* of the head main body 30 of the transfer head H.

Specifically, the positioning bump 61 is a swollen bump integrally formed simultaneously with forming of the head main body 30, and the engaging part at the leading end has an arc contour shape corresponding to the notch 60. The location of the positioning bump 61 is slightly behind the leading end pressing portion 25, and is at both sides in the width direction of the mark transfer tape T.

In the mark transfer operation of the mark transfer tool 1, when the notches 60, 60 are engaged with the positioning bumps 61, 61, a hooking phenomenon occurs in the traveling action of the mark transfer tape T, and transfer complete position of one transfer mark M is known by bodily sensation.

The other configuration and operation are same as in embodiment 1.

Figure 11A:
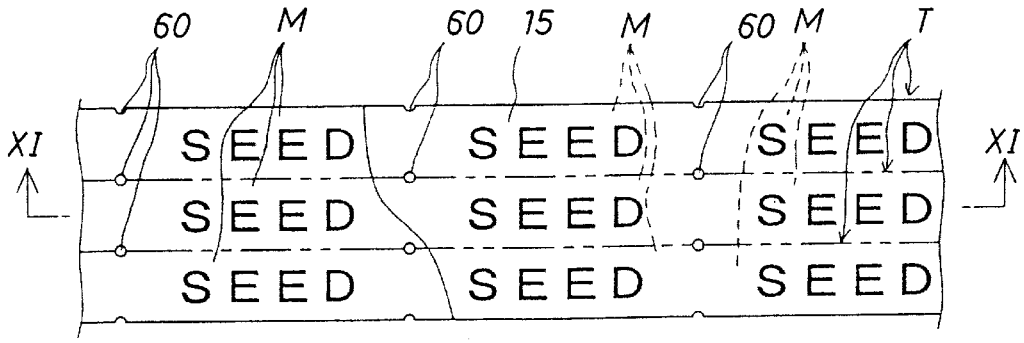
FIG. 11A is a plan of mark transfer tape of the mark transfer tool, showing a partially cut-away view of the mark transfer tape in the manufacturing process.
Figure 11B:
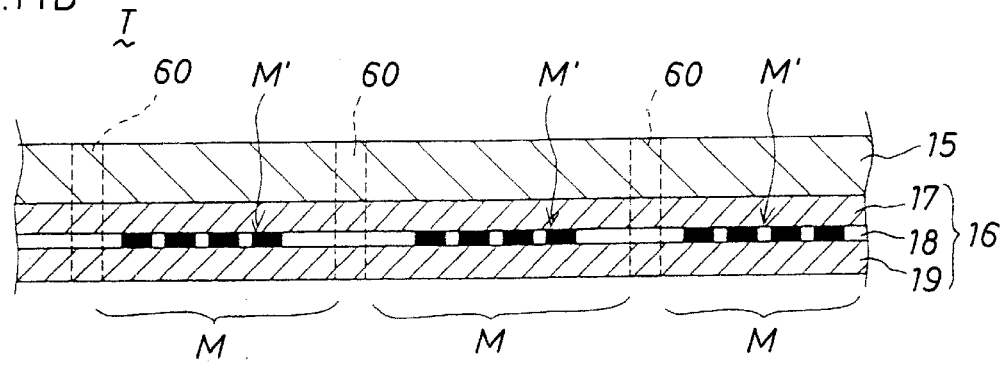
FIG. 11B is a sectional view along line XI—XI in FIG. 11A of the mark transfer tape.
Figure 11C:
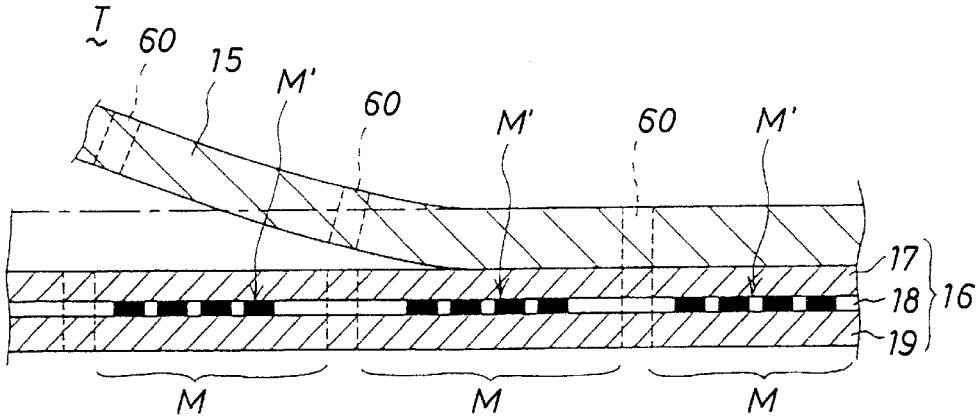
FIG. 11C is a sectional view showing a peeling state of base tape and transfer mark layer of the mark transfer tape.
Figure 12A:
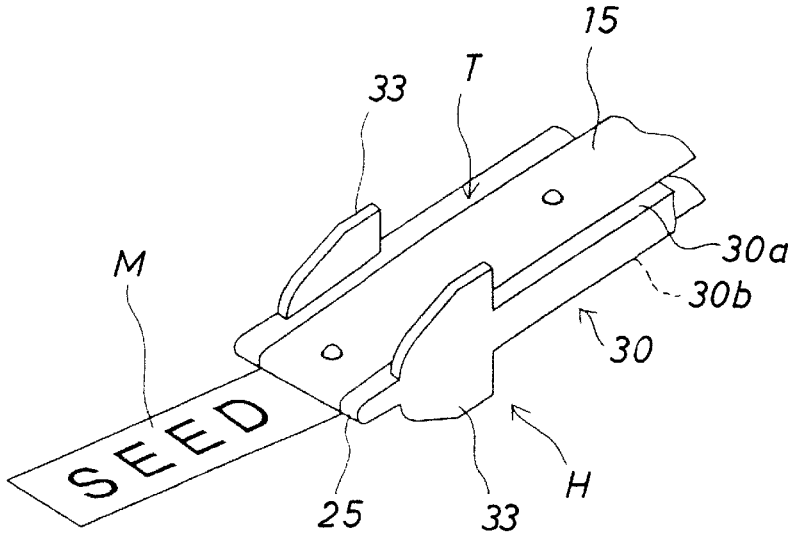
FIG. 12A is a perspective view showing essential parts of transfer head of mark transfer tool according to embodiment 5 of the invention.
Figure 12B:
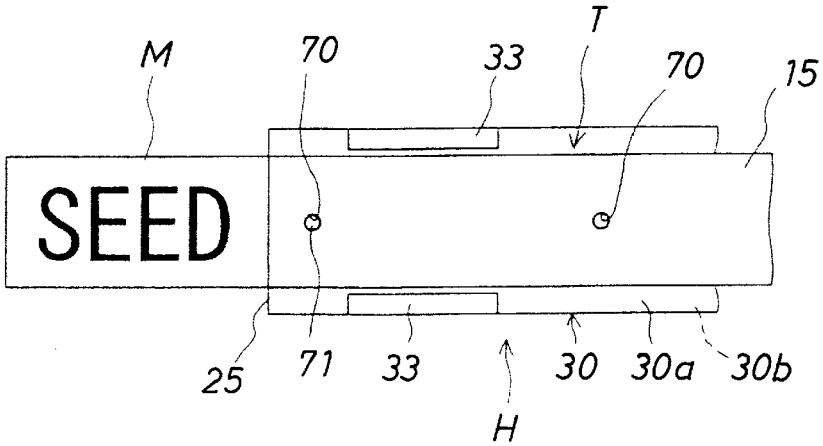
FIG. 12B is a plan showing essential parts of the transfer head.
Figure 12C:
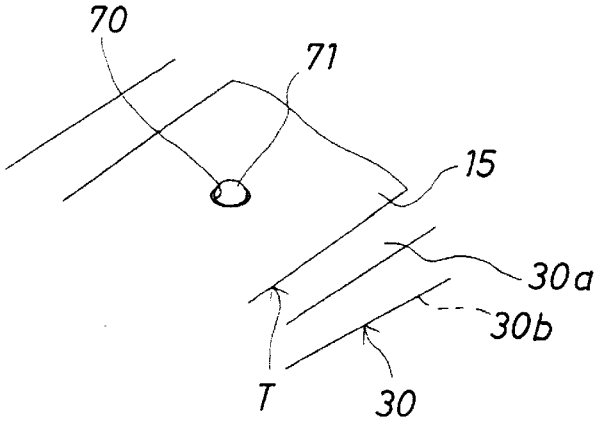
FIG. 12C is a partially magnified perspective view of essential parts of the transfer head.
Figure 13A:
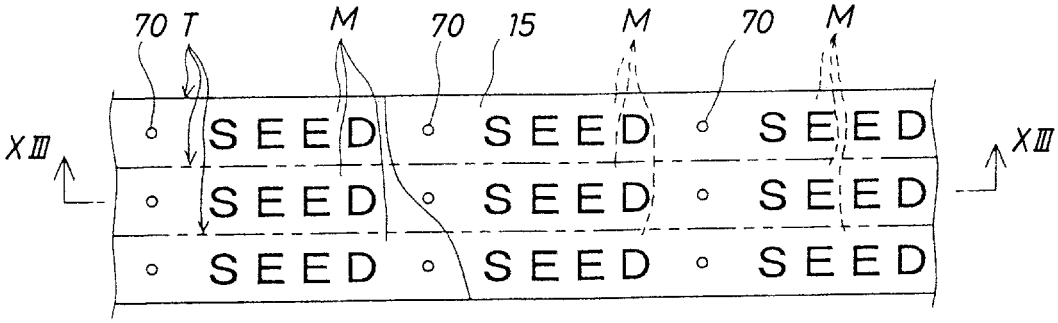
FIG. 13A is a plan of mark transfer tape of the mark transfer tool, showing a partially cut-away view of the mark transfer tape in the manufacturing process.
Figure 13B:
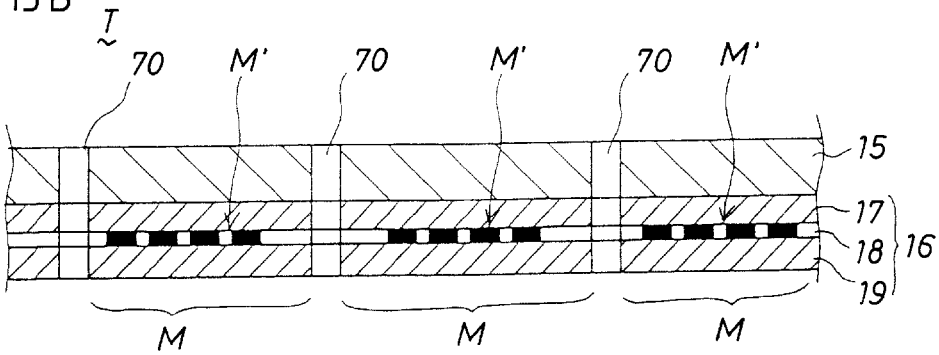
FIG. 13B is a sectional view along line XIII—XIII in FIG. 13A of the mark transfer tape.
Figure 13C:
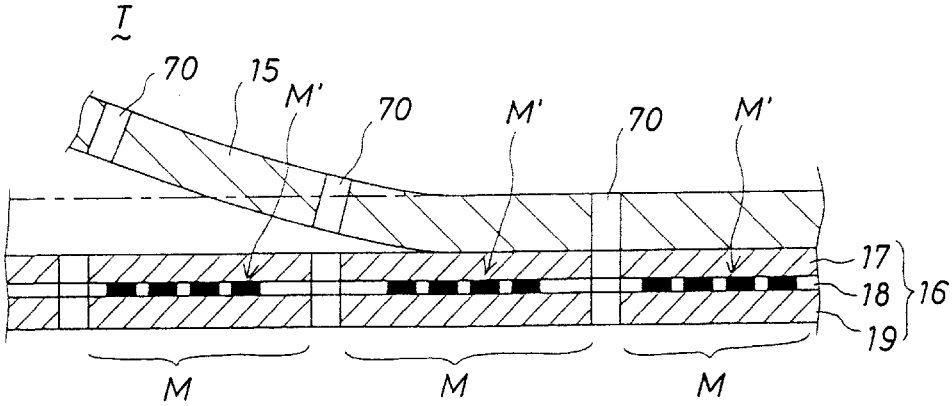
FIG. 13C is a sectional view showing a peeling state of base tape and transfer mark layer of the mark transfer tape.
Figure 14A:
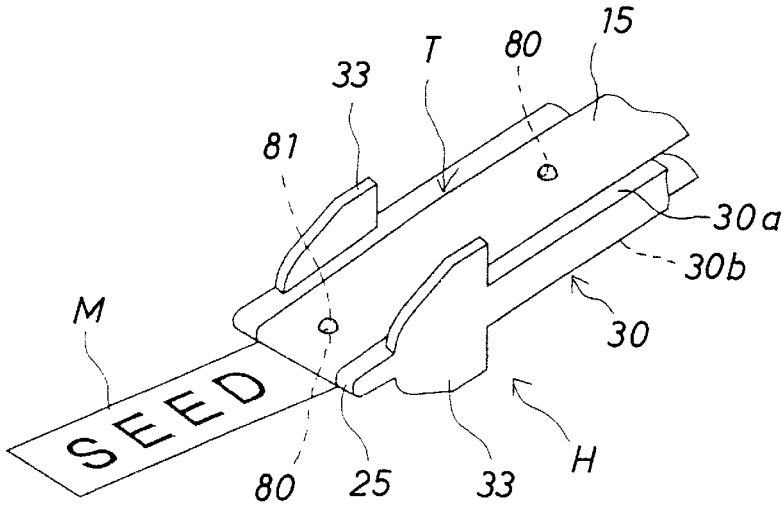
FIG. 14A is a perspective view showing essential parts of transfer head of mark transfer tool according to embodiment 6 of the invention.
Figure 14B:
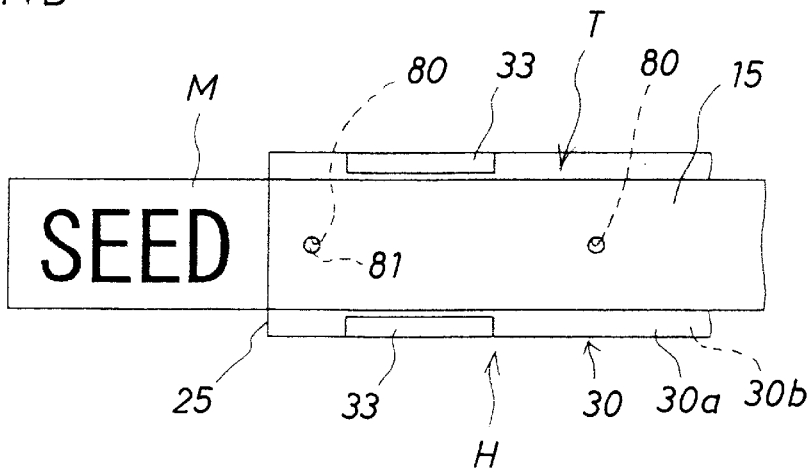
FIG. 14B is a plan showing essential parts of the transfer head.
Figure 14C:
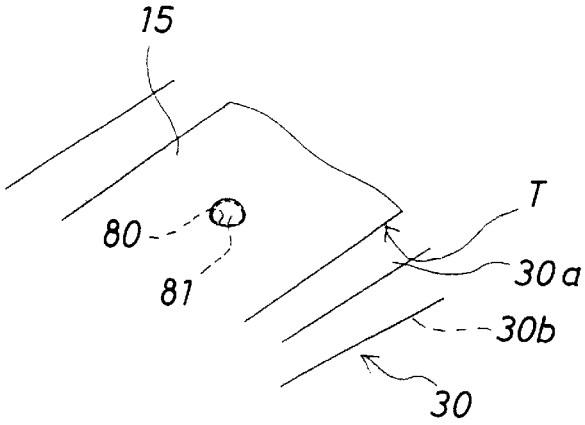
FIG. 14C is a partially magnified perspective view of essential parts of the transfer head.
Figure 15A:
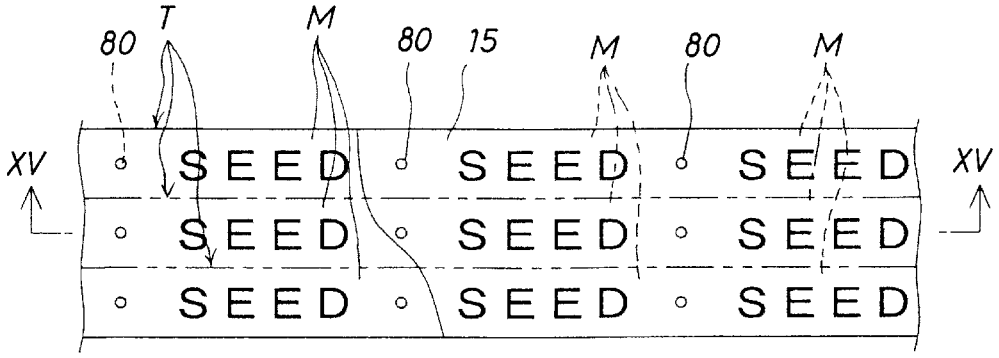
FIG. 15A is a plan of mark transfer tape of the mark transfer tool, showing a partially cut-away view of the mark transfer tape in the manufacturing process.
Figure 15B:
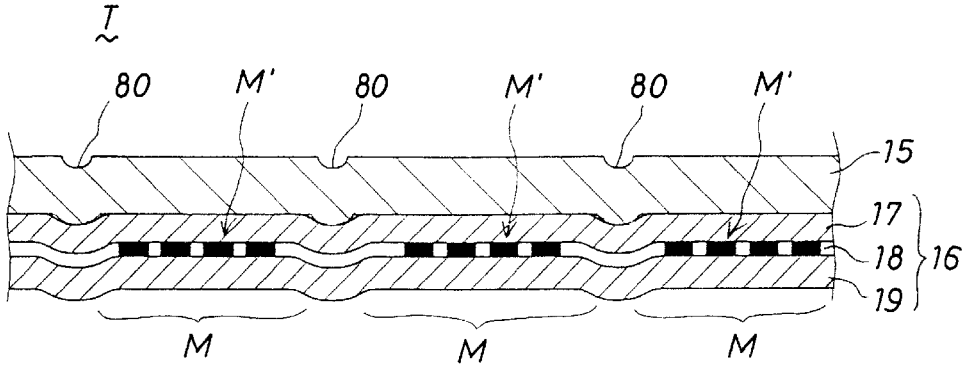
FIG. 15B is a sectional view along line XV—XV in FIG. 15A of the mark transfer tape.
Figure 15C:
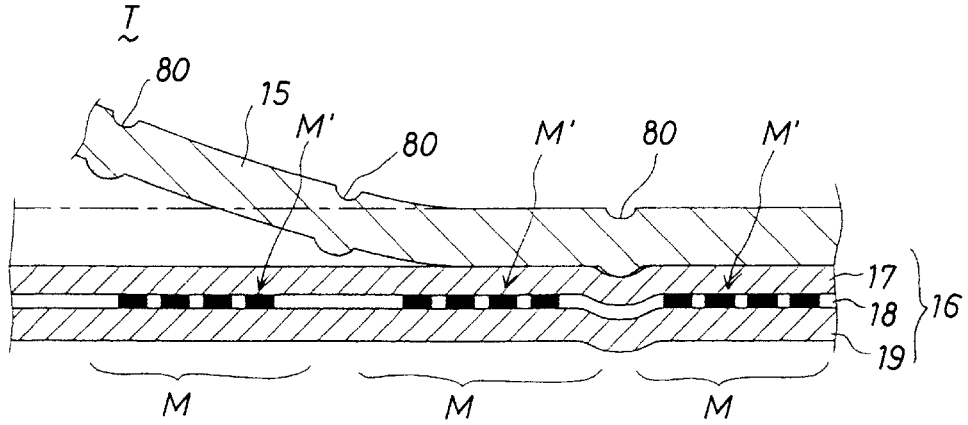
FIG. 15C is a sectional view showing a peeling state of base tape and transfer mark layer of the mark transfer tape.

The mark transfer tape T in this embodiment is, same as in embodiment 1, manufactured as a band having a tape width corresponding to plural mark transfer tapes T, T, . . . as shown in FIG. 11A, and cut and formed in a width of one tape T by slitter or other cutting device.

Actually, therefore, after the transfer mark layer 16 is formed on the surface side of the base tape 15, the division bodily sensing means 60 is pierced by punch or other piercing device, and therefore this division bodily sensing means 60 penetrates throughout the entire tape transfer tape T.

Embodiment 5

This embodiment is shown in FIGS. 12A–12C and FIGS. 13A–13C, in which the specific structure of the bodily sensing recess (bodily sensing means) in embodiment 4 is slightly modified.

That is, same as in embodiment 4, a bodily sensing recess 70 of the embodiment is formed between mutually adjacent transfer marks M, M of the mark transfer tape T, but the notch 70 in this embodiment is tiny holes provided in the center in the width direction of the mark transfer tape T, and the tiny holes 70 are circular in order to prevent breakage of the base tape 15 due to stress concentration.

Corresponding to this, a bodily sensing engaging part 71 provided in the transfer head H is a positioning bump so as to be engaged with the tiny hole 70 in convex-concave relation.

This positioning bump 71 is, specifically, a swollen bump integrally formed simultaneously with forming of the head main body 30, and its contour is circular corresponding to the notch 70. The location of the positioning bump 71 is slightly behind the leading end pressing portion 25, and is at the central position in the width direction of the mark transfer tape T.

The other configuration and operation are same as in embodiment 4.

Embodiment 6

This embodiment is shown in FIGS. 14A–14C and FIGS. 15A–15C, in which the specific structure of the bodily sensing recess (bodily sensing means) in embodiment 5 is slightly modified.

That is, same as in embodiment 5, a bodily sensing recess 80 of the embodiment is a concave form provided in the center of the width direction of the mark transfer tape T, but the recess 80 in this embodiment is a dent provided in the center of the width direction at the back side of the mark transfer tape T.

This dent 80 is specifically curved from back side to surface side in part of the base tape 15, and its contour is circular.

Corresponding to this, a bodily sensing engaging part 81 provided in the transfer head H is a positioning bump so as to be engaged with the dent 80 in convex-concave relation.

This positioning bump 81 is, specifically, a swollen bump same as the positioning bump 71 in embodiment 5, and its contour is circular corresponding to the dent 80.

The other configuration and operation are same as in embodiment 5.

Embodiment 7

This embodiment is shown in FIGS. 16A–16C and FIGS. 17A–17C, in which the specific structure of the mark transfer tape T in embodiment 1 is slightly modified.

Figure 16A:
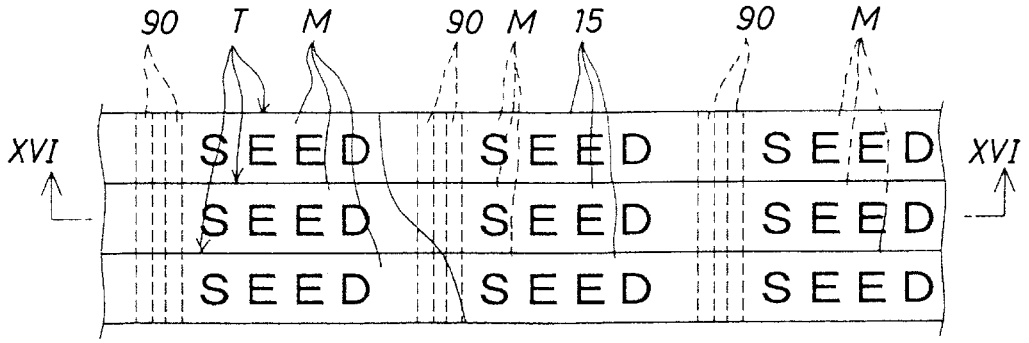
FIG. 16A is a plan of mark transfer tape of mark transfer tool according to embodiment 7 of the invention, showing a partially cut-away view of the mark transfer tape in the manufacturing process.
Figure 16B:
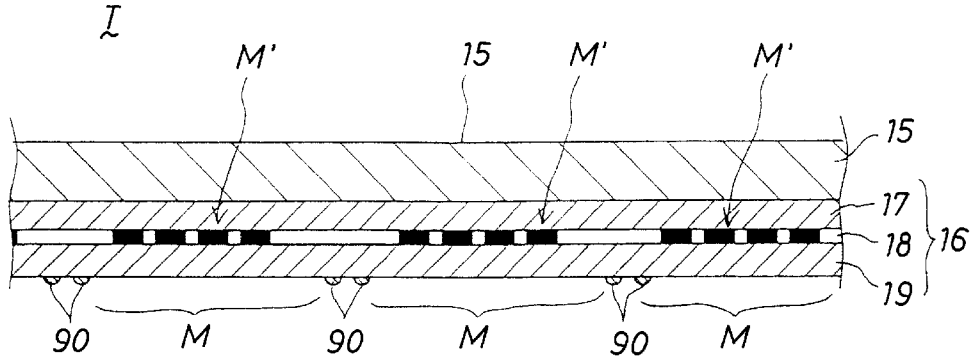
FIG. 16B is a sectional view along line XVI—XVI in FIG. 16A of the mark transfer tape.
Figure 16C:
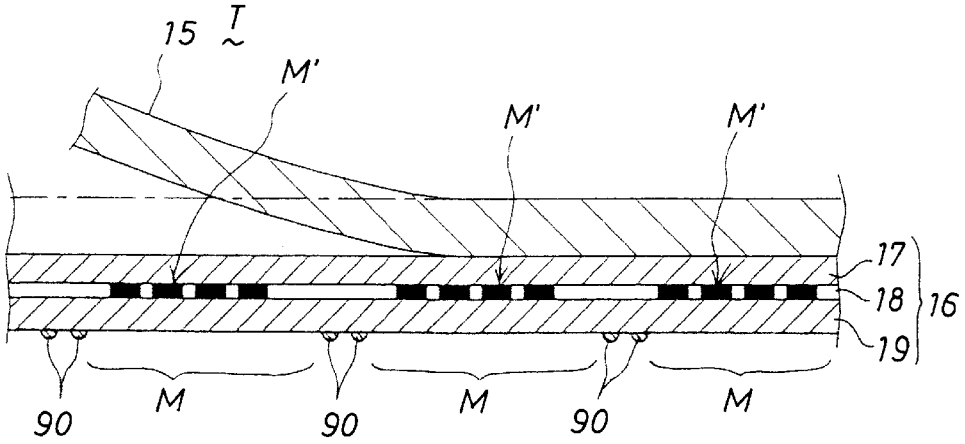
FIG. 16C is a sectional view showing a peeling state of base tape and transfer mark layer of the mark transfer tape.

That is, in the mark transfer tape T of this embodiment, division bodily sensing means 90 is plural bodily sensing bumps formed between mutually adjacent transfer marks M, M. These bodily sensing bumps 90 are specifically two swollen formed provided on the surface (the lower side in FIG. 16B and FIG. 16C) of the transfer mark layer 16 as shown in FIG. 16.

Figure 17A:
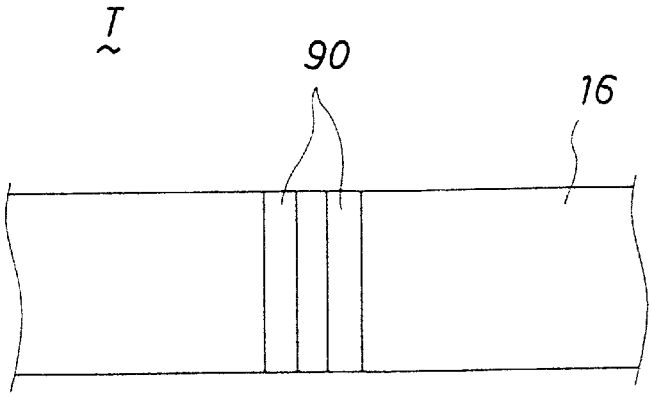
FIG. 17A is a plan showing a configuration of bodily sensing bump of the mark transfer tape.

These two bodily sensing bumps 90, 90 extend linearly parallel to the width direction of the mark transfer tape T between the transfer marks M, M of the transfer mark layer 16 as shown in FIG. 17A, a bodily sensing engaging part 91 of the transfer head H is engaged with the these bodily sensing bumps 90, 90 in convex-concave relation.

In the shown example, same as in embodiment 1, the leading edge of the transfer head H, that is, the leading end pressing portion 25 functions also as this bodily sensing engaging part 91 (not shown).

In mark transfer operation of the mark transfer tool 1, when the leading end pressing portion 25 of the transfer head H is engaged between the two bodily sensing bumps 90, 90, a hooking phenomenon occurs in the traveling motion of the mark transfer tape T, and transfer complete position of one transfer mark M is known by bodily sensation.

The other configuration and operation are same as in embodiment 1.

Figure 17B:
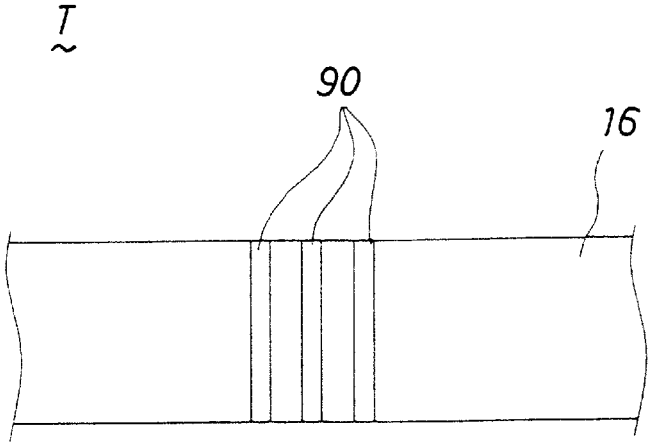
FIG. 17B is also a plan showing a configuration of bodily sensing bump of the mark transfer tape.
Figure 17C:
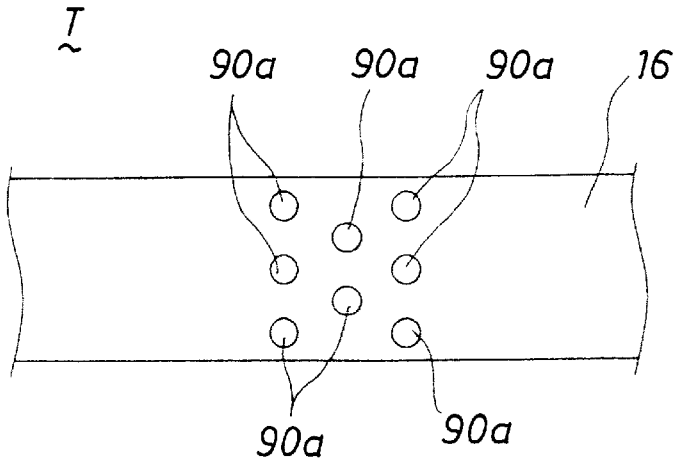
FIG. 17C is also a plan showing a configuration of bodily sensing bump of the mark transfer tape.

The specific shape and array structure of the bodily sensing bumps 90 are not limited to the examples in FIGS. 16A–16C and FIG. 17A, but other configurations having similar function, as shown in FIG. 17B and FIG. 17C may be also employed.

That is, in the configuration shown in FIG. 17B, three bodily sensing bumps 90, 90, 90 are provided linearly parallel to the width direction of the mark transfer tape T, and in the configuration shown in FIG. 17C, a plurality of swollen bodily sensing bumps 90*a* having a circular contour are arranged parallel in three rows.

Embodiment 8

Figure 18A:
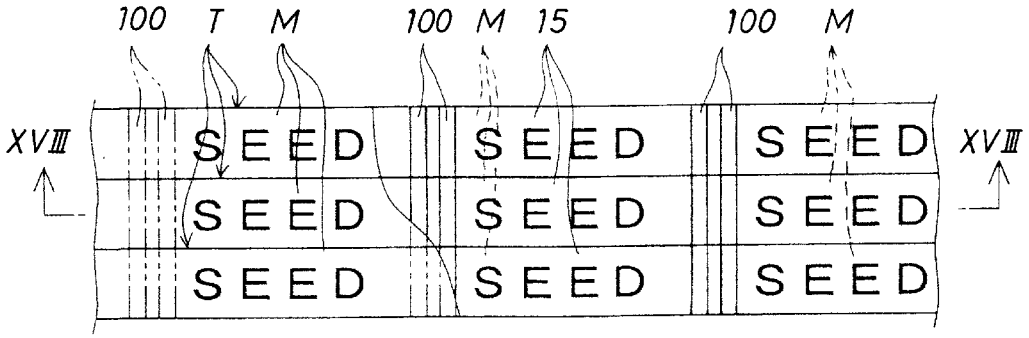
FIG. 18A is a plan of mark transfer tape of mark transfer tool according to embodiment 8 of the invention, showing a partially cut-away view of the mark transfer tape in the manufacturing process.
Figure 18B:
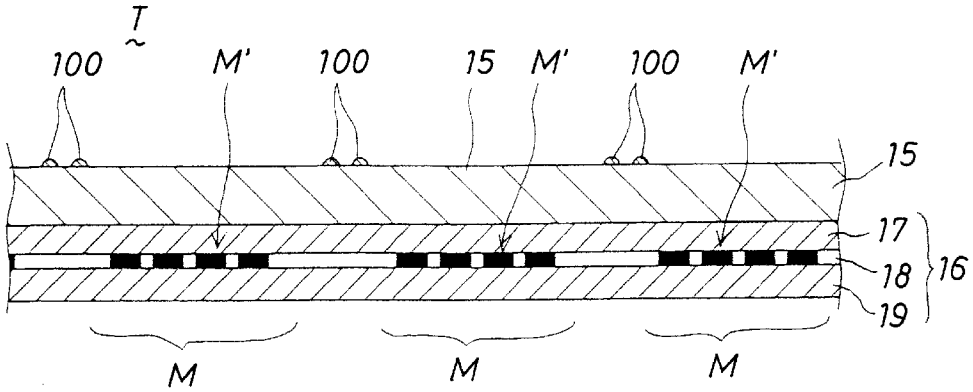
FIG. 18B is a sectional view along line XVIII—XVIII in FIG. 18A of the mark transfer tape.
Figure 18C:
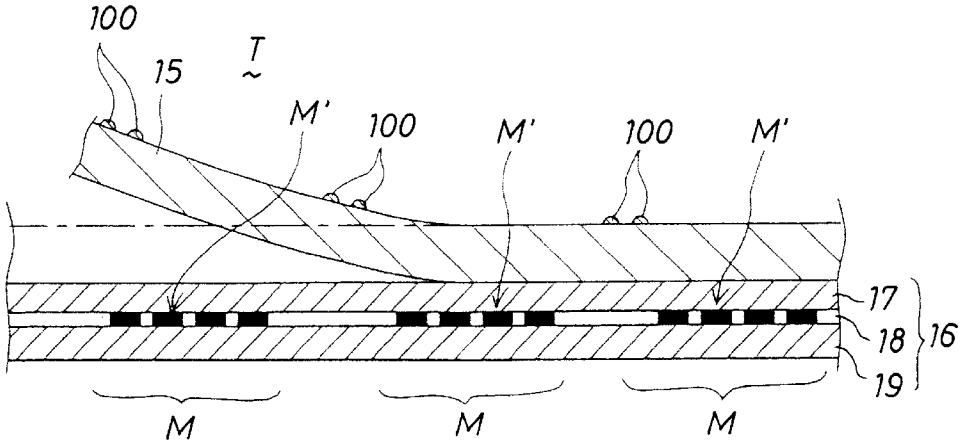
FIG. 18C is a sectional view showing a peeling state of base tape and transfer mark layer of the mark transfer tape.

This embodiment is shown in FIGS. 18A–18C, in which the specific structure of the mark transfer tape T in embodiment 7 is slightly modified.

That is, same as in embodiment 7, division bodily sensing means 100 in this embodiment is plural bodily sensing bumps formed between mutually adjacent transfer marks M, M, but the bodily sensing bumps 100 in this embodiment are specifically two swollen formed provided on the back side (the lower side in FIG. 16B and FIG. 16C) of the transfer mark layer 16 as shown in FIGS. 18A–18C.

These two bodily sensing bumps 90, 90 extend linearly parallel to the width direction of the back side of the base tape 15 between the transfer marks M, M of the transfer mark layer 16 as shown in FIG. 17A, a bodily sensing engaging part 101 of the transfer head H is engaged between the these bodily sensing bumps 100, 100 directly in convex-concave relation.

The other configuration and operation are same as in embodiment 7.

Embodiment 9

Figure 19:
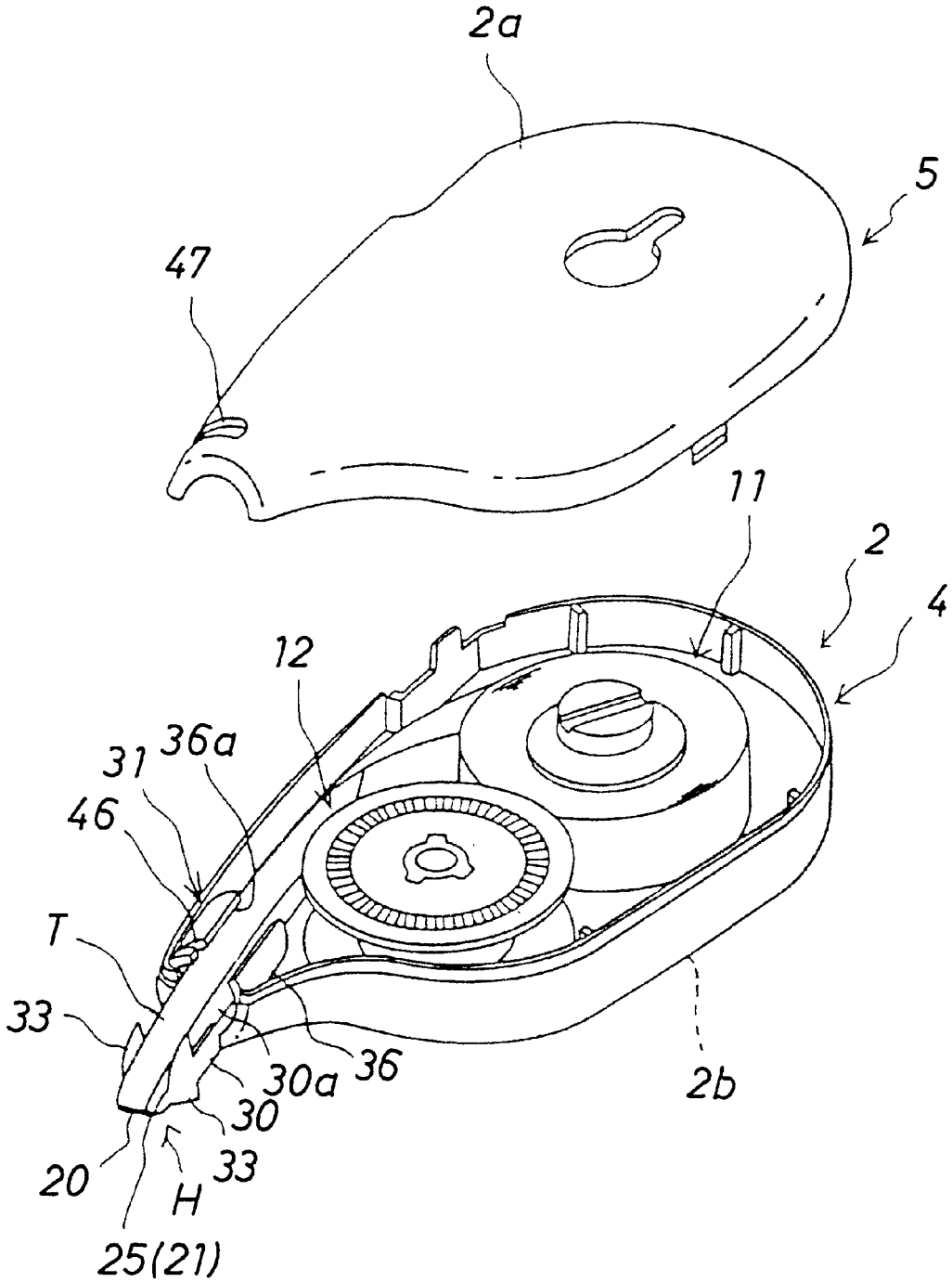
FIG. 19 is a perspective exploded view of mark transfer tool according to embodiment 9 of the invention.

This embodiment is shown in FIG. 19, in which the basic structure of the mark transfer tool 1 is modified.

That is, in the mark transfer tool 1 of the foregoing embodiments, the mark transfer tape T as a consumable part is an exchangeable cartridge type, that is, refill type, whereas this embodiment presents a one-time disposable type, that is, all component parts including the mark transfer tape T are consumable parts.

In the mark transfer tool 1 of the embodiment, in a hand-held case 2, a pay-out reel 11 on which a mark transfer tape T is wound, and a take-up reel 12 for collecting the mark transfer tape T after use are installed, and a transfer head H is disposed at the leading end of the case 2 so as to be rotatable about its head axial center. The specific structure of the transfer head H is same as in embodiment 1, except for its mounting position.

Although not shown specifically, in the case main body 4 of the case 2, aside from the pay-out reel 11 and take-up reel 12, a tape interlock unit for mutually interlocking these reels 11, 12, a clutch mechanism for synchronizing the pay-out speed and take-up speed of the mark transfer tape T by the pay-out reel 11 and take-up reel 12, and other principal and basic mechanical parts are also assembled in a unit.

The other configuration and operation are same as in embodiment 1.

Embodiment 10

Figure 20A:
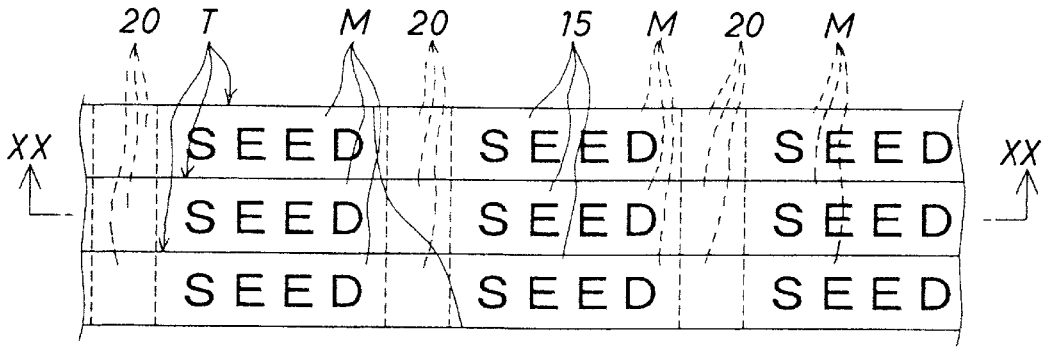
FIG. 20A is a plan of mark transfer tape of mark transfer tool according to embodiment 10 of the invention, showing a partially cut-away view of the mark transfer tape in the manufacturing process.
Figure 20B:
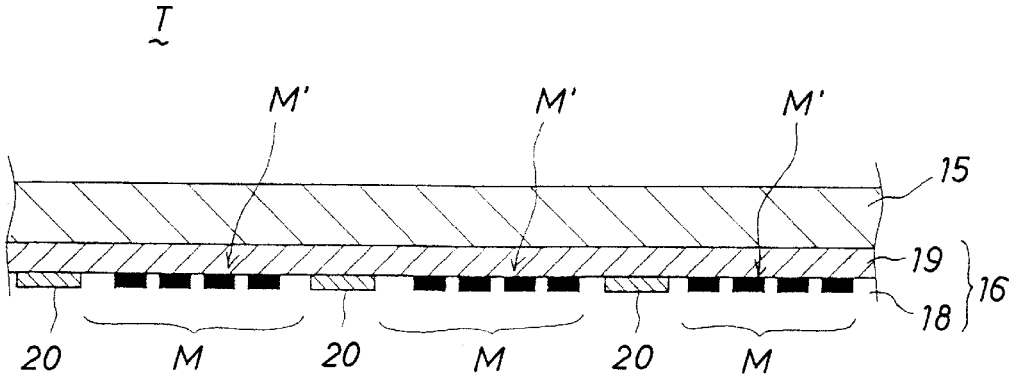
FIG. 20B is a sectional view along line XX—XX in FIG. 20A of the mark transfer tape.
Figure 20C:
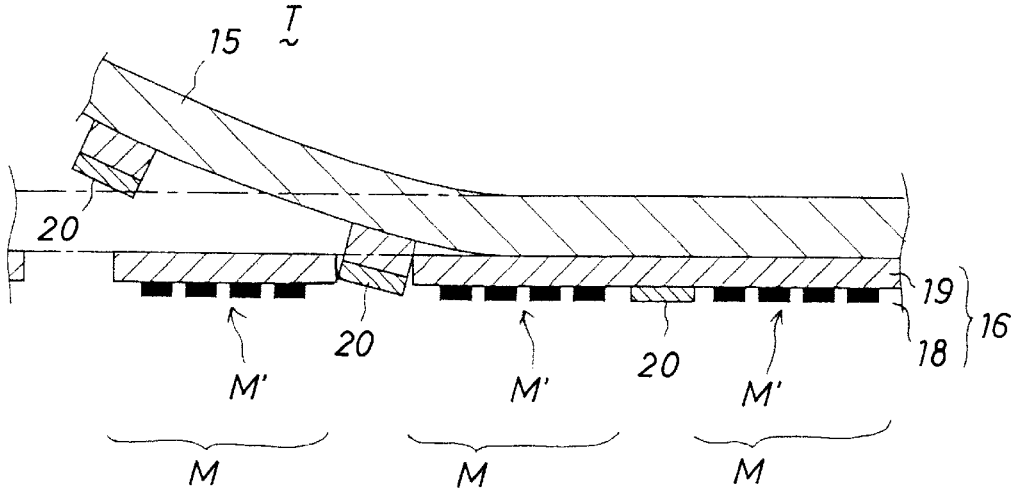
FIG. 20C is a sectional view showing a peeling state of base tape and transfer mark layer of the mark transfer tape.

This embodiment is shown in FIGS. 20A–20C, in which the structure of the mark transfer tape T is modified.

That is, in the mark transfer tape T of this embodiment, as shown in FIGS. 20A–20C, a transfer tape layer 16 to be adhered and held on the surface side (lower side in FIG. 20B and FIG. 20C) of a base tape 15 is an integral laminate structure consisting of a pressure-sensitive adhesive layer 19 and a mark array layer 18.

In the embodiment, the pressure-sensitive adhesive layer 19 also functions as the mark forming layer 17 in embodiment 1, and the mark array layer 18 is printed and formed on the surface of this mark forming layer 17.

Thus laminated transfer mark layer 16 is, as shown, adhered and held on the surface of the base tape 15 treated for parting (the lower side in FIG. 20B and FIG. 20C) peelably and separably through the pressure-sensitive adhesive layer 19.

In a specific forming method of the transfer mark layer 16, the bodily sensing sliding part 20 is printed and formed on the surface of the base tape 15, and the pressure-sensitive adhesive layer 19 is applied and formed on the surface of the base tape 15, and the mark array layer 18 is printed and formed on the surface of the pressure-sensitive adhesive layer 19.

The other configuration and operation are same as in embodiment 1.

Embodiment 11

Figure 21A:
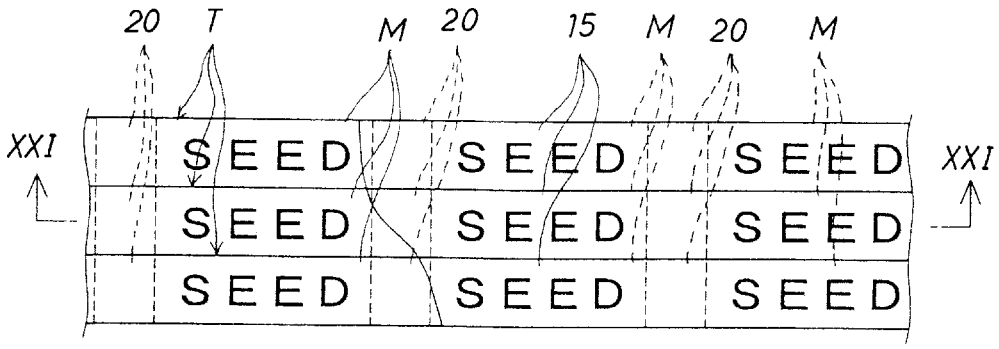
FIG. 21A is a plan of mark transfer tape of mark transfer tool according to embodiment 11 of the invention, showing a partially cut-away view of the mark transfer tape in the manufacturing process.
Figure 21B:
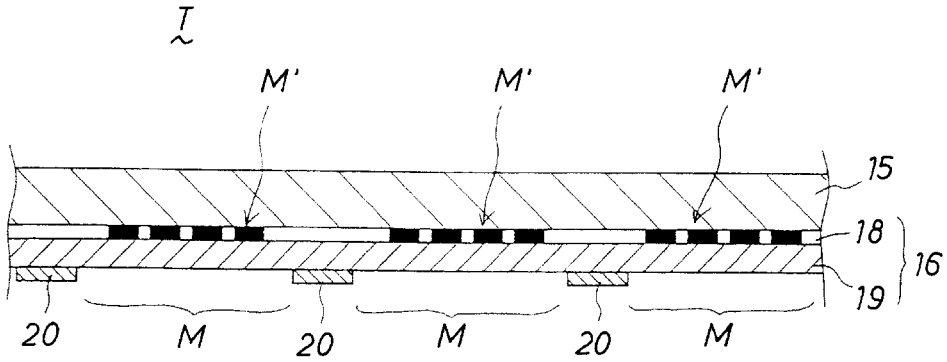
FIG. 21B is a sectional view along line XXI—XXI in FIG. 21A of the mark transfer tape.
Figure 21C:
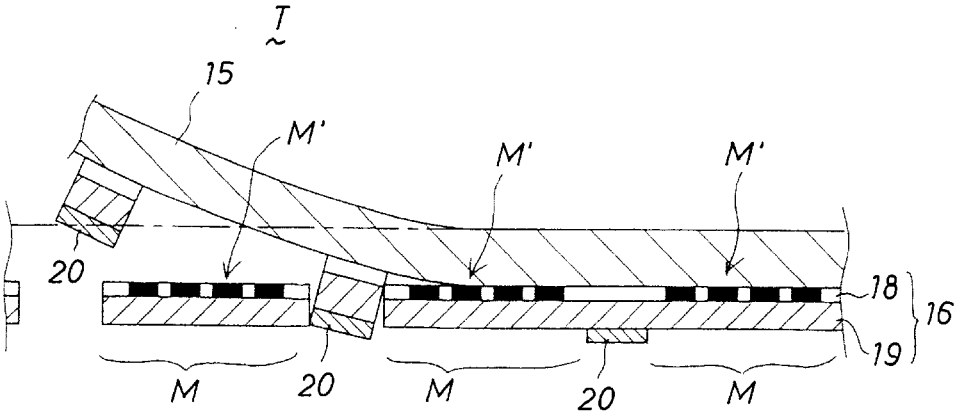
FIG. 21C is a sectional view showing a peeling state of base tape and transfer mark layer of the mark transfer tape.

This embodiment is shown in FIGS. 21A–21C, in which the structure of the mark transfer tape T is modified.

That is, in the mark transfer tape T of this embodiment, as shown in FIGS. 21A–21C, a transfer tape layer 16 to be adhered and held on the surface side (lower side in FIG. 21B, (c)) of a base tape 15 is an integral laminate structure consisting of a mark array layer 18 and a pressure-sensitive adhesive layer 19, and the mark forming layer 17 in the mark transfer tape T in embodiment 1 is omitted.

In other words, the mark array layer 18 is directly printed and formed on the parting treated surface of the base tape 15, and when transferring a mark, therefore, the mark array layer 18 is peeled from the surface of the base tape 15, and the surface layer is formed directly. The other configuration and operation are same as in embodiment 1.

Embodiment 12

Figure 22A:
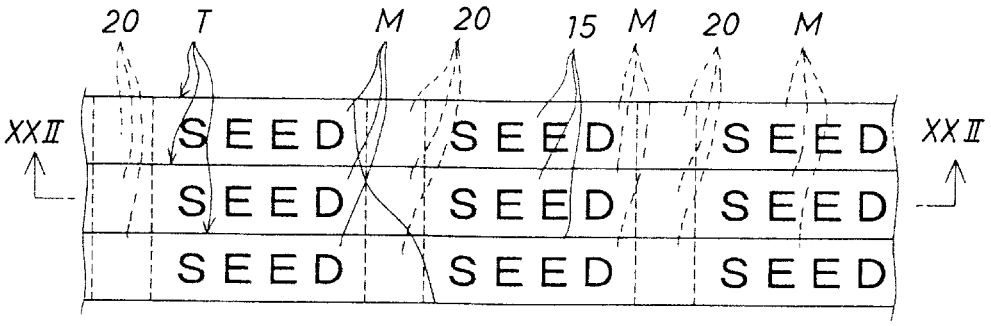
FIG. 22A is a plan of mark transfer tape of mark transfer tool according to embodiment 12 of the invention, showing a partially cut-away view of the mark transfer tape in the manufacturing process.
Figure 22B:
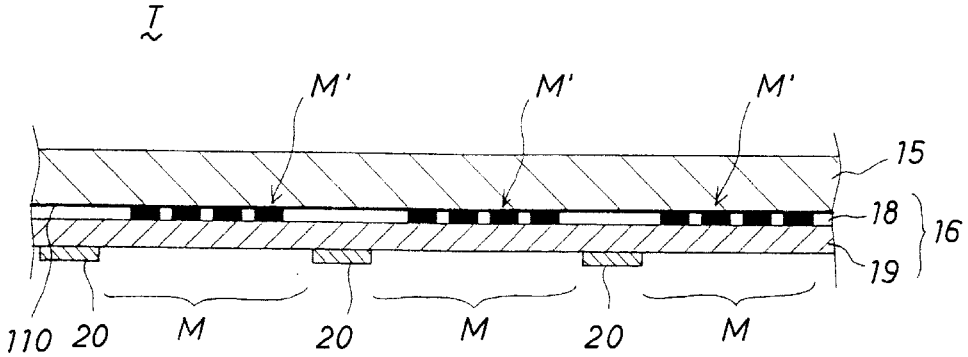
FIG. 22B is a sectional view along line XXII—XXII in FIG. 22A of the mark transfer tape.
Figure 22C:
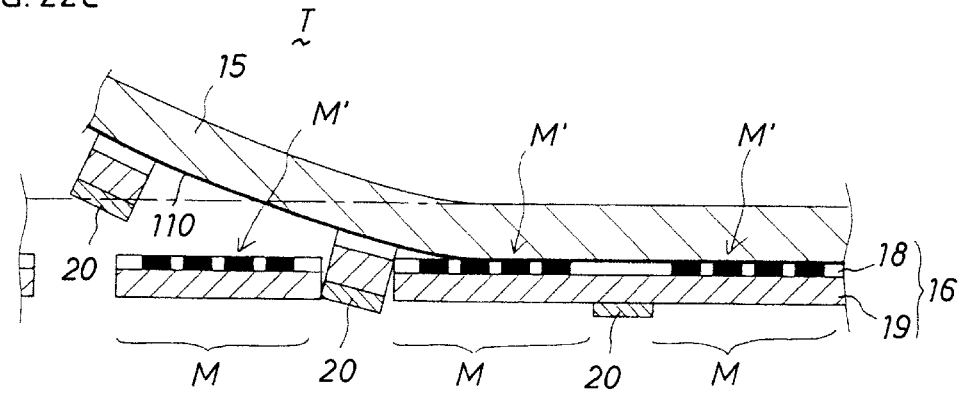
FIG. 22C is a sectional view showing a peeling state of base tape and transfer mark layer of the mark transfer tape.

This embodiment is shown in FIGS. 22A–22C, in which the structure of the mark transfer tape T in embodiment 10 is slightly modified.

That is, in the mark transfer tape T of this embodiment, as shown in FIGS. 22A–22C, the surface side (lower side in FIG. 22B and FIG. 22C) of a base tape 15 is treated to be adhesive 110, and a mark array layer 18 is directly printed and formed on this surface. When transferring a mark, therefore, the mark array layer 18 is peeled from the surface of the base tape 15, and the surface layer is formed directly.

The other configuration and operation are same as in embodiment 10.

The foregoing embodiments are only preferred embodiments for carrying out the invention, and the invention is not limited by them, but can be changed and modified in various forms within its scope.

As described herein, the mark transfer tool of the invention is a mark transfer tool for transferring a transfer mark on a mark transfer tape on a sheet of paper or the like, and more specifically it comprises a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the correction area, being disposed at the leading end of the case, in which the mark transfer tape has pressure-sensitive adhesive transfer marks disposed and held continuously at specific intervals peelably on the surface of a base tape, and further division bodily sensing means showing division positions of transfer marks is disposed between transfer marks, and bodily sensing engaging parts to be engaged with the division bodily sensing means of the mark transfer tape are disposed on the tape traveling area of the transfer head, and therefore it presents a novel mark transfer technology completely different from the conventional mark using technology, about various marks composed of characters, codes, patterns or their combination, by making use of stamp, impression, mark seal or adhesion technology, so as to be effectively applicable to diversified preferences of general users.

That is, when transferring a transfer mark on the mark transfer tape on a desired correction area of a sheet of paper or the like by using the mark transfer tool of the invention, the case is gripped by fingers, and the leading end pressing portion of the transfer head is tightly pressed to the correction area, and is moved along the sheet of paper, so that the transfer mark is transferred.

More specifically, with the division bodily sensing means provided in the mark transfer tape being engaged with the bodily sensing engaging part of the transfer head, the transfer head is tightly pressed to the transfer start end on the correction area, and the case is directly moved along the sheet of paper, and is stopped when the next division bodily sensing means is engaged with the bodily sensing engaging part to cause a sliding phenomenon at this engaging position or a hooking phenomenon in the traveling action of the mark transfer tape.

By this operation, the transfer mark on the mark transfer tape in the leading end pressing portion of the transfer head is peeled from the transfer head, and is precisely transferred on the correction area, and the used mark transfer tape after peeling the transfer mark, that is, the base tape is taken up and collected on the take-up reel.

Exemplary embodiments presented in the detailed description of the invention above are intended to disclose the technical features of the invention, and it is to be understood that the invention is not limited to those illustrated embodiments alone but is interpreted in a wider sense of meaning, and that various changes and modifications may be effected without departing from the scope or true spirit of the invention.

What is claimed is:

1. A mark transfer tool for transferring a transfer mark on a mark transfer tape on a sheet of paper or the like, comprising:

a hand-held case, a pay-out reel containing a mark transfer tape, being rotatably installed in the case, a take-up reel for collecting the used mark transfer tape, being rotatably installed in the case, and a transfer head for pressing and transferring the mark transfer tape being paid out from the pay-out reel onto the correction area, being disposed at the leading end of the case, wherein said mark transfer tape has pressure-sensitive adhesive transfer marks disposed and held continuously at specific intervals peelably on the surface of a base tape, and further division bodily sensing means showing division positions of transfer marks is disposed between transfer marks, and a bodily sensing engaging part to be engaged with the division bodily sensing means of the mark transfer tape is disposed in the tape traveling part of the transfer head.

2. The mark transfer tool of claim 1, wherein said division bodily sensing means is a bodily sensing sliding part formed between mutually adjacent transfer marks in the mark transfer tape, and said bodily sensing engaging part is a leading edge of the transfer head, and in mark transfer operation, when the bodily sensing sliding part is engaged with the leading edge of the transfer head, a sliding phenomenon occurs in the engaging position, so that transfer complete position of one transfer mark is known by bodily sensation.

3. The mark transfer tool of claim 2, wherein said bodily sensing sliding part is disposed at the surface side of the mark transfer tape, and in mark transfer operation, when the bodily sensing sliding part is engaged with the leading edge of the transfer head, sliding occurs between the bodily sensing sliding part and the correction area, so that transfer complete position of one transfer mark is known by bodily sensation.

4. The mark transfer tool of claim 1, wherein said division bodily sensing means is a bodily sensing recess formed between mutually adjacent transfer marks in the mark transfer tape, and said bodily sensing engaging part is a positioning bump provided in the transfer head, and in mark transfer operation, when the bodily sensing recess is engaged with the positioning bump of the transfer head, a hooking phenomenon occurs in the traveling motion of the mark transfer tape, so that transfer complete position of one transfer mark is known by bodily sensation.

5. The mark transfer tool of claim 4, wherein said bodily sensing recess is an arc-shaped notch provided at least in one end part in the width direction of the mark transfer tape, and the positioning bump has an arc contour shape corresponding to this notch.

6. The mark transfer tool of claim 4, wherein said bodily sensing recess is a circular tiny hole provided in the center in the width direction of the mark transfer tape, and the positioning bump has a circular contour shape corresponding to this notch.

7. The mark transfer tool of claim 4, wherein said bodily sensing recess is a circular dent provided in the center in the width direction of the mark transfer tape, and the positioning bump has a circular contour shape corresponding to this dent.

8. The mark transfer tool of claim 1, wherein said division bodily sensing means is plural bodily sensing bumps formed between mutually adjacent transfer marks in the mark transfer tape, and said bodily sensing engaging part is a positioning bump provided in the transfer head, and in mark transfer operation, when the positioning bump is engaged between the plural bodily sensing bumps, a hooking phenomenon occurs in the traveling motion of the mark transfer tape, so that transfer complete position of one transfer mark is known by bodily sensation.

9. The mark transfer tool of claim 8, wherein said plural bodily sensing bumps are disposed at the surface side of the mark transfer tape, and said bodily sensing engaging part is a leading edge of the transfer head, and in mark transfer operation, when the leading edge of the transfer head is engaged between the plural bodily sensing bumps, a hooking phenomenon occurs in the traveling motion of the mark transfer tape, so that transfer complete position of one transfer mark is known by bodily sensation.

10. The mark transfer tool of claim 8, wherein said plural bodily sensing bumps are disposed at the back side of the mark transfer tape, and said bodily sensing engaging part is a leading edge of the transfer head, and in mark transfer operation, when the leading edge of the transfer head is engaged between the plural bodily sensing bumps, a hooking phenomenon occurs in the traveling motion of the mark transfer tape, so that transfer complete position of one transfer mark is known by bodily sensation.

11. The mark transfer tool of claim 1, wherein it is of refill type having a structure that at least a tape cartridge comprising the pay-out reel and take-up reel is detachably disposed in the case so that the mark transfer tape may be exchanged.

12. The mark transfer tool of claim 1, wherein it is of onetime type having the pay-out reel and take-up reel installed in the case, with the transfer head provided at the leading end of the case.

13. A mark transfer taped is posed and used in a mark transfer tool for transferring a transfer mark on a sheet of paper, wherein pressure-sensitive adhesive transfer marks are disposed and held continuously at specific intervals peelably on the surface of abase tape, and further division bodily sensing means showing division positions of transfer marks is disposed between transfer marks, and this division bodily sensing means is configured to indicate the division position of one transfer mark by bodily sensation when engaged with a bodily sensing engaging part provided on the transfer head of the mark transfer tool in the mark transfer operation of the mark transfer tool.

14. The mark transfer tape of claim 13, wherein a transfer mark layer composed of multiple transfer marks is adhered and held peelably at the surface side of the base tape of which back side is treated for parting.

15. The mark transfer tape of claim 13, wherein a transfer mark layer composed of multiple transfer marks is adhered and held peelably and detachably at the surface side of the base tape of which back side is treated for parting.

16. The mark transfer tape of claim 14 or 15, wherein said transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape processed to be peelable, peelably and detachably in pieces through the pressure-sensitive adhesive layer.

17. The mark transfer tape of claim 14 or 15, wherein said transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark forming layer.

18. The mark transfer tape of claim 14 or 15, wherein said transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and detachably in pieces through the mark array layer.

19. The mark transfer tape of claim 14 or 15, wherein said transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be adhesive, peelably and detachably in pieces through the mark array layer.

20. The mark transfer tape of claim 14, wherein said division bodily sensing means is a bodily sensing sliding part formed of the surface of the base tape between mutually adjacent transfer mark layers, and in mark transfer operation, when the bodily sensing sliding part is engaged with the leading edge of the transfer head of the mark transfer tool, sliding occurs between the bodily sensing sliding part and the correction area, so that transfer complete position of one transfer mark is known by bodily sensation.

21. The mark transfer tape of claim 15, wherein said division bodily sensing means is a bodily sensing sliding part formed corresponding to mutually adjacent transfer mark layers on the surface of the transfer mark layer, and in mark transfer operation, when the bodily sensing sliding part is engaged with the leading edge of the transfer head of the mark transfer tool, sliding occurs between the bodily sensing sliding part and the correction area, so that transfer complete position of one transfer mark is known by bodily sensation.

22. The mark transfer tape of claim 14 or 15, wherein said division bodily sensing means is a bodily sensing recess formed between mutually adjacent transfer mark layers on the back side of the transfer mark layer, and in mark transfer operation, when the bodily sensing recess is engaged with the bodily sensing engaging part provided the transfer head of the mark transfer tool in convex-concave relation, hooking occurs in the tape traveling motion, so that transfer complete position of one transfer mark is known by bodily sensation.

23. The mark transfer tool of claim 22, wherein said bodily sensing recess is an arc-shaped notch provided at least in one end part in the width direction of the base tape, is engaged with the bodily sensing engaging part of the transfer head having an arc contour shape corresponding to this notch in convex-concave relation.

24. The mark transfer tool of claim 22, wherein said bodily sensing recess is a circular tiny hole provided in the center in the width direction of the mark transfer tape, is engaged with the bodily sensing engaging part of the transfer head having a circular contour shape corresponding to this tiny hole in convex-concave relation.

25. The mark transfer tool of claim 22, wherein said bodily sensing recess is a circular dent provided in the center in the width direction of the mark transfer tape, is engaged with the bodily sensing engaging part of the transfer head having a circular contour shape corresponding to this dent in convex-concave relation.

26. The mark transfer tool of claim 14 or 15, wherein said division bodily sensing means is plural bodily sensing bumps formed between mutually adjacent transfer marks in the mark transfer tape, and in mark transfer operation, when the bodily sensing engaging part provided in the transfer head of the mark transfer tool is engaged between the plural bodily sensing bumps in convex-concave relation, a hooking phenomenon occurs in the tape traveling motion, so that transfer complete position of one transfer mark is known by bodily sensation.

27. The mark transfer tool of claim 26, wherein said plural bodily sensing bumps are disposed at the surface of the transfer mark layer, and in mark transfer operation, when the leading edge of the transfer head of the mark transfer tool is engaged with the plural bodily sensing bumps, a hooking phenomenon occurs in the tape traveling motion, so that transfer complete position of one transfer mark is known by bodily sensation.

28. The mark transfer tool of claim 26, wherein said plural bodily sensing bumps are disposed at the back side of the base tape, and in mark transfer operation, when the leading edge of the transfer head of the mark transfer tool is engaged with the plural bodily sensing bumps, a hooking phenomenon occurs in the tape traveling motion, so that transfer complete position of one transfer mark is known by bodily.

* * * * *